US006076444A

United States Patent [19]

Okonski

[11] Patent Number: 6,076,444

[45] Date of Patent: Jun. 20, 2000

[54] PANEL CUTTING APPARATUS WITH SELECTABLE MATRICES FOR VACUUM AND AIR

[75] Inventor: Frank Okonski, Harwood Heights, Ill.

[73] Assignee: Best Cutting Die Company, Skokie, Ill.

[21] Appl. No.: 08/905,262

[22] Filed: Aug. 1, 1997

[51] Int. Cl.[7] ..... B26D 7/02; B26D 7/26

[52] U.S. Cl. ..... 83/99; 83/100; 83/152; 83/346; 83/663; 83/698.21; 83/698.42

[58] Field of Search ..... 83/343, 346, 347, 83/24, 99, 98, 100, 152, 911, 698.21, 698.41, 698.42, 663

[56] References Cited

U.S. PATENT DOCUMENTS

| | | | |
|---|---|---|---|
| Re. 32,128 | 4/1986 | Blumle | 271/94 |
| 642,220 | 1/1900 | Green . | |
| 884,218 | 4/1908 | Schwarz et al. . | |
| 1,168,767 | 1/1916 | Unruh . | |
| 1,618,191 | 2/1927 | Hemberger . | |
| 1,746,048 | 2/1930 | Novick . | |
| 1,766,244 | 6/1930 | Cumfer . | |
| 1,777,285 | 10/1930 | Adsit . | |
| 1,927,728 | 9/1933 | Wolff . | |
| 2,055,295 | 9/1936 | Kessler . | |
| 2,277,405 | 3/1942 | McKiernan | 101/171 |
| 2,299,650 | 10/1942 | Parks, Jr. et al. | 164/68 |
| 2,386,147 | 10/1945 | Sidebotham | 164/22 |
| 2,791,276 | 5/1957 | Weller . | |
| 2,837,025 | 6/1958 | Pechy . | |
| 2,898,854 | 8/1959 | Crawford . | |
| 3,008,366 | 11/1961 | Taylor, Jr. . | |
| 3,032,152 | 5/1962 | Titsler | 189/36 |
| 3,106,121 | 10/1963 | Novick | 83/152 |
| 3,128,681 | 4/1964 | Miller . | |
| 3,172,321 | 3/1965 | Schrader . | |
| 3,190,194 | 6/1965 | Kirby et al. | 93/58.2 |
| 3,198,093 | 8/1965 | Kirby et al. | 93/58.2 |
| 3,209,630 | 10/1965 | McCartan . | |
| 3,244,335 | 4/1966 | Downie | 225/1 |
| 3,257,885 | 6/1966 | Hornung . | |
| 3,270,602 | 9/1966 | Kirby et al. . | |
| 3,289,513 | 12/1966 | Johnson et al. | 83/344 |
| 3,460,443 | 8/1969 | Sarka et al. | 93/58.2 |
| 3,522,754 | 8/1970 | Sauer . | |
| 3,523,474 | 8/1970 | Kinslow, Jr. | 83/40 |
| 3,527,127 | 9/1970 | Stovall . | |
| 3,530,794 | 9/1970 | Ritzerfeld . | |
| 3,533,355 | 10/1970 | Wall . | |
| 3,578,761 | 5/1971 | Sarka | 83/343 |
| 3,602,079 | 8/1971 | Carlson | 83/67 |

(List continued on next page.)

FOREIGN PATENT DOCUMENTS

| | | |
|---|---|---|
| 743783 | of 0000 | Canada . |
| 0 312 422 A1 | of 0000 | European Pat. Off. . |
| 0 312 422 B1 | 4/1992 | European Pat. Off. . |
| 0 519 661 A1 | 12/1992 | European Pat. Off. . |
| 2435331 | of 0000 | France . |
| 1016112 | of 0000 | Germany . |
| 28 52 521 | of 0000 | Germany . |
| 3544358 | of 0000 | Germany . |
| 1235372 | of 0000 | United Kingdom . |
| 1322090 | of 0000 | United Kingdom . |
| 2 133 734 | 8/1984 | United Kingdom . |
| WO 83/04004 | of 0000 | WIPO . |

*Primary Examiner*—Rinaldi I. Rada
*Assistant Examiner*—Boyer Ashley
*Attorney, Agent, or Firm*—Sitrick & Sitrick

[57] ABSTRACT

A magnetic cutting assembly and waste removal system is provided for cutting a panel from an envelope blank or the like. The die holder has a magnetic outer surface and a plurality of surface orifices therein radially communicating with corresponding feed tubes for supplying vacuum or air to the surface and into the vicinity of the envelope blank. In order to maximize the number of orifices while minimizing the number of magnetic members, the magnetic members are disposed in a plurality of rows wherein each row contains alternating magnets and orifices and a row of orifices are disposed between each adjacent row of magnets, and the orifices are connected to corresponding feed tubes in a matrix.

34 Claims, 17 Drawing Sheets

U.S. PATENT DOCUMENTS

| | | | |
|---|---|---|---|
| 3,602,970 | 9/1971 | Smith | 29/118 |
| 3,611,855 | 10/1971 | Thousand, Jr. | 83/100 |
| 3,618,438 | 11/1971 | Simson . | |
| 3,668,752 | 6/1972 | Clifton et al. . | |
| 3,670,646 | 6/1972 | Welch, Jr. . | |
| 3,709,077 | 1/1973 | Trogan et al. | 83/152 |
| 3,730,092 | 5/1973 | Pickard et al. . | |
| 3,744,384 | 7/1973 | Jarritt et al. . | |
| 3,752,042 | 8/1973 | Castille . | |
| 3,789,715 | 2/1974 | Schuchardt et al. . | |
| 3,797,351 | 3/1974 | Jones, Jr. . | |
| 3,810,055 | 5/1974 | Wright . | |
| 3,823,633 | 7/1974 | Ross | 83/346 |
| 3,824,926 | 7/1974 | Fukuyama | 101/378 |
| 3,824,927 | 7/1974 | Pugh et al. . | |
| 3,850,059 | 11/1974 | Kang . | |
| 3,886,825 | 6/1975 | Tanaka | 83/13 |
| 3,898,899 | 8/1975 | Weinstein | 83/29 |
| 3,903,768 | 9/1975 | Amberg et al. | 83/24 |
| 3,965,786 | 6/1976 | D'Luhy . | |
| 3,975,976 | 8/1976 | Prentice . | |
| 3,977,283 | 8/1976 | Helm . | |
| 4,004,479 | 1/1977 | Bodnar . | |
| 4,020,724 | 5/1977 | Quinlan . | |
| 4,127,265 | 11/1978 | Wirz et al. . | |
| 4,187,752 | 2/1980 | Chesnut | 83/663 |
| 4,191,076 | 3/1980 | Bollmer et al. | 83/13 |
| 4,226,150 | 10/1980 | Reed | 83/346 |
| 4,233,873 | 11/1980 | Jessen . | |
| 4,237,786 | 12/1980 | Sanford . | |
| 4,270,910 | 6/1981 | Himmelsbach . | |
| 4,289,492 | 9/1981 | Simpson | 493/371 |
| 4,402,265 | 9/1983 | Pickard | 101/382 MV |
| 4,450,740 | 5/1984 | Chapman, Jr. et al. . | |
| 4,537,588 | 8/1985 | Ehlscheid et al. . | |
| 4,549,454 | 10/1985 | Yamashita . | |
| 4,553,461 | 11/1985 | Belongia | 83/344 |
| 4,558,620 | 12/1985 | Wallis . | |
| 4,625,928 | 12/1986 | Peekna | 242/7.02 |
| 4,645,484 | 2/1987 | Niske . | |
| 4,671,152 | 6/1987 | Blumle . | |
| 4,676,161 | 6/1987 | Peekna | 101/378 |
| 4,726,804 | 2/1988 | Stitcher . | |
| 4,742,769 | 5/1988 | Zeller . | |
| 4,744,297 | 5/1988 | Sardella et al. | 101/382 MV |
| 4,770,078 | 9/1988 | Gautier | 83/344 |
| 4,809,609 | 3/1989 | Sugiura et al. . | |
| 4,816,105 | 3/1989 | Yamashita | 83/663 X |
| 4,823,659 | 4/1989 | Falasconi . | |
| 4,831,930 | 5/1989 | Leanna | 101/389.1 |
| 4,842,485 | 6/1989 | Barber | 416/144 |
| 4,878,407 | 11/1989 | Harrison et al. . | |
| 4,920,630 | 5/1990 | Leanna | 29/521 |
| 4,920,843 | 5/1990 | Stromberg et al. | 83/346 |
| 4,982,639 | 1/1991 | Kirkpatrick . | |
| 5,003,854 | 4/1991 | Capdebosco | 83/331 |
| 5,005,816 | 4/1991 | Stemmler et al. | 270/39 |
| 5,074,180 | 12/1991 | Mayer et al. . | |
| 5,095,830 | 3/1992 | Love . | |
| 5,109,741 | 5/1992 | Fuchs . | |
| 5,119,707 | 6/1992 | Fischer . | |
| 5,138,923 | 8/1992 | Kent et al. | 83/665 |
| 5,186,108 | 2/1993 | Hillebrand . | |
| 5,211,096 | 5/1993 | Steidinger . | |
| 5,230,271 | 7/1993 | Hardisty et al. . | |
| 5,373,758 | 12/1994 | Gerhardt | 76/107.8 |
| 5,452,634 | 9/1995 | Wilson | 83/346 X |
| 5,555,786 | 9/1996 | Fuller . | |
| 5,570,620 | 11/1996 | Okonski et al. . | |
| 5,782,156 | 7/1998 | Collins | 83/698.42 X |

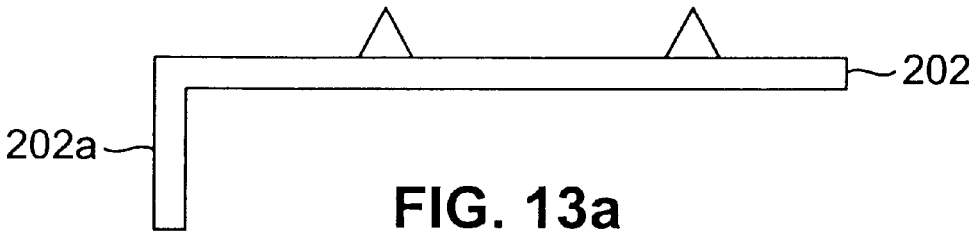
FIG. 13a
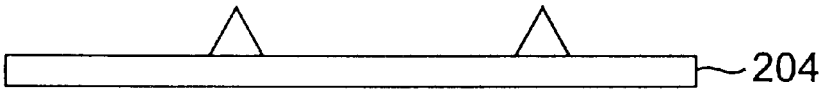
FIG. 13b
FIG. 13c
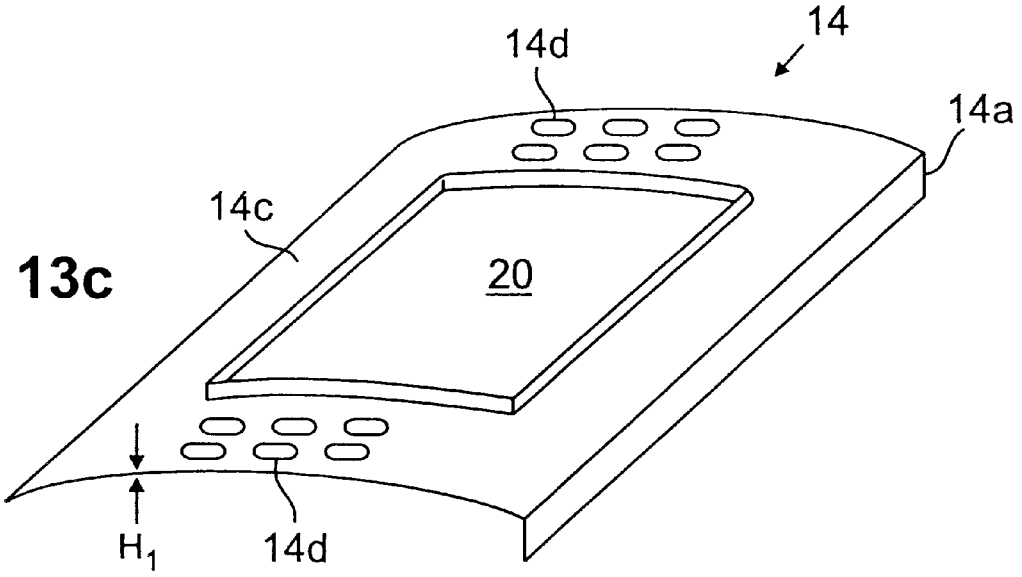

PANEL CUTTING APPARATUS WITH SELECTABLE MATRICES FOR VACUUM AND AIR

FIELD OF THE INVENTION

The present invention relates generally to a magnetic rotary cutting device, and more particularly, an apparatus for the cutting of windows, notches, orifices, or other patterns in relatively thin, flexible sheet-like material in either sheet or web form, and the corresponding removal of waste material therefrom.

BACKGROUND OF THE INVENTION

Many envelopes have a transparent panel or window for allowing visual inspection of the enclosure. These window envelopes are often manufactured from a web of paper material which is initially cut into blanks having a predetermined shape. A panel is subsequently cut from the blank by a panel cutting apparatus to form the window. Thereafter, the blank is then typically folded, gummed, printed, and packaged to form a finished envelope.

U.S. Pat. No. 4,823,659 to Falasconi describes a conventional rotary panel cutting apparatus having a cutting tool in the form of a cutting plate or die and a rotary die holder which brings the cutting die into successive contact with the envelope blanks which advance on a conveyor system. The cutting die has a raised cutting edge which is adapted to engage the blank and cut the panel. The die holder, sometimes called a die cylinder or drum, is mounted for rotation on a drive shaft synchronized with the conveyor system so that the cutting die engages a different envelope blank for each rotation of the die holder.

The surface of the Falasconi die holder has a plurality of transport and vacuum orifices which communicate with corresponding air chambers which, in turn, communicate with a source of vacuum or compressed air. The transport orifices are adapted to engage the envelope blank and, when the vacuum source is activated, carry the blank adjacent to the surface of the die holder. The rotation of the die holder carries the envelope to a cutting station where the blank is passed between the cutting die and a cutting bar so as to cut the panel in the envelope blank.

The vacuum orifices are disposed within the periphery of the dies' cutting edges and, when the vacuum source is activated, form a localized vacuum zone within the vicinity of the cutting die to retain and carry away the panel which is cut from the envelope blanks. The envelope blank and the cut panel may be released from the die holder and the cutting die, respectively, by terminating the vacuum source or applying the compressed air to the transport and vacuum orifices. The vacuum and compressed air supply to each opening is controlled by means of valves or attachment tubes which are manually attached to each individual orifice. The attachment tubes typically rotate in unison with the die holder.

Unfortunately, the prior art panel cutting apparatuses suffer from numerous drawbacks. Since the die holder typically rotates from zero to about 1500 rpm, it is extremely difficult to obtain a proper seal between the rotating vacuum tubes and the feed tubes which permits the envelope blank to move, resulting in improper alignment between the cutting die and the envelope blank. Similarly, it is extremely difficult to obtain a proper seal at the vacuum orifices between the die holder and the drive shaft due to wear and abrasion, resulting in insufficient vacuum to carry the envelope blank and the panel and jamming of the cutting apparatus. It is also difficult to apply the vacuum or air at the correct time during the rotation of the die holder. These problems are successfully addressed by U.S. Pat. No. 5,570,620 issued to the present inventor.

Another drawback is the lack of adjustability of the apparatus to cut out panels of different sizes as well as different locations on the blank. Attempts to provide an adjustable die holder capable of receiving different size cutting dies have been unsuccessful because the holding mechanisms, such as removable cover plates and holding keys, used to attach the cutting dies to the die holders leave significant areas without the vacuum orifices necessary to carry the envelope blank and the panel. In addition, these attempts have resulted in die holders which become unbalanced during rotation.

In order to minimize the assembly and disassembly downtime, magnetic clamp assemblies, having magnetic strips disposed in the surface of the die holder to magnetically attract and hold the cutting die, have been used. Unfortunately, the forces resulting from the rotation of the die holder may cause the cutting die to slide laterally on the surface of the magnets. To prevent the lateral movement of the cutting die, magnetic die holders have also utilized complicated mechanical clamping assemblies to hold at least the leading end of the cutting die while the magnetic clamps hold the remaining portion of the cutting die. Conventional edge clamps suffer a serious drawback in that although the leading edge must be clamped securely prior art clamping means are designed such that the clamp refrains from creasing the leading edge, a feat which in actual practice is extremely difficult. An example of this conventional practice is found in U.S. Pat. No. 5,555,786 to Fuller.

The Fuller device also attempts to prevent lateral movement by increasing the magnetic force and maximizing the number of magnetic strips disposed in the die holder surface which correspondingly and problematically results in minimizing the number of the vacuum orifices available for retaining the envelope blank and panel in the first instance.

Finally, with conventional rotary cutting apparatus, when such a die cuts patterns from material, such as windows out of paper envelopes, the scrap material cut, such as chips of paper, does not always completely disengage from the original material. Even if the scrap material did disengage from the original material, there is still a likelihood that the scrap material would be left on the cutting die plate near the edges of the pattern being cut.

This residual scrap material, left on the original material, or on the cutting die plate, causes the cutting machinery to jam, resulting in down time, breakage of tooling, waste of material, and slowing down of machine operation to compensate for the residual scrap material buildup.

Yet another problem with conventional rotary cutting apparatus has to do with adequately holding the material to be cut to the surface of the rotary cutter. High rotation speeds can create lifting forces on the leading edge of material to be cut, thus creating a potential material jam at the interface of the cutting die and the cutting bar.

OBJECTS AND SUMMARY OF THE INVENTION

Accordingly, it is an object of the invention is to provide an improved cutting tool for cutting panels from blanks of sheet-like material.

A primary object of the invention is to provide an improved cutting die system for material retention and expulsion which is adaptable for orientation at a plethora of predetermined locations on a magnetic cutting tool surface.

Another object of the invention is to provide an improved magnetic die holder for a panel cutting tool.

It is a related object of the invention to provide a magnetic die holder which may be easily and readily adjusted to position the cutting die.

It is an object of the invention to provide a cutting tool having an improved distribution of magnets and air orifices.

A more specific object of the invention is to provide a magnetic cutting tool which both maximizes the number of magnetic strips while maximizing the number of vacuum orifices disposed over the die holder surface.

Another object of the invention is to provide a magnetic die holder which prevents the cutting die from moving laterally on the die holder surface with no stress on the cutting die leading or trailing ends.

It is an object of the invention to provide an improved scrap removal system for a magnetic cutting tool for cutting patterns in sheet-like material.

Yet another object of the invention is to provide a matrix of vacuum orifices and air orifices on the surface of the rotary holder of the invention such that concentrated zones of air, or vacuum, or both, can be provided at predetermined locations of the rotary holder surface such that, for example, the material to be cut can be more securely held at the leading edge, or at any other desired location thereof.

A rotary cutting assembly is provided for cutting a panel from an envelope blank or the like. The cutting assembly comprises a flexible magnetically compatible cutting die mounted on a magnetic die holder adapted to be mounted on a drive shaft for rotating about an axis. The die holder has a plurality of surface orifices radially communicating with corresponding longitudinally directed feed tubes for supplying vacuum or air to the surface and into the vicinity of the envelope blank.

In accordance with one aspect of the invention, a novel air delivery assembly is provided for delivering vacuum and/or air to the die holder. The air delivery assembly comprises a stationary plate disposed at least at one end of the die holder and defining a groove member for selectively supplying vacuum and/or air so that a supply of vacuum or air is selectively supplied at the surface orifices of the die holder when rotation of the die holder aligns the longitudinal feed tubes with the groove member.

In one embodiment, the air delivery assembly comprises a transport assembly and a vacuum assembly disposed on opposing sides of the die holder. The transport assembly is adapted to feed vacuum to the die holder and vicinity thereof in order to retain the envelope blank adjacent to the die holder and "transport" the envelope blank as the holder rotates through the cutting operation. The vacuum assembly, in turn, is adapted to feed vacuum to the die holder in order to retain the panel cut from the envelope blank adjacent to the die holder until a predetermined position is reached wherein the panel is released from the die holder. At predetermined positions, the transport and vacuum assemblies may feed compressed air to the die holder and/or vicinity thereof in order to release the envelope blank and the panel, respectively.

The operator may select whether individual feed tubes (and the corresponding orifices) communicate with either the transport assembly or the vacuum assembly. In applications where the envelope blank is adjacent to the certain predetermined orifices and it is desired to retain the envelope blank adjacent the die holder, the feed tubes corresponding to the predetermined orifices communicate with the transport assembly. Conversely, if the panel is adjacent to the predetermined orifices, the feed tubes corresponding to the predetermined orifices communicate with the vacuum assembly.

In accordance with certain objects of the invention, the magnetic die holder has an outer surface having a slot extending along the longitudinal axis for detachably receiving the leading end of the cutting die and a plurality of magnetic members disposed in the die holder surface for attracting the cutting die. In a preferred embodiment, the die holder may have a plurality of orifices disposed between adjacent magnetic members for delivering vacuum or air to the die holder surface. In order to maximize the number of orifices while maximizing the number of magnetic members available, it is preferred that the magnetic members be disposed in a plurality of rows wherein each row contains alternating magnets and orifices and a row of orifices are disposed between each adjacent row of magnets.

The orifices of the present invention are arrayed in a predefined matrix on the face of the rotary holder and the orifices are in communication with the lateral feed tubes carrying vacuum and air thereto. This enables the provision and concentration of air or vacuum, or both, at any desired location of the rotary holder surface. An exemplary embodiment of the invention utilizes the concentration of air and vacuum at a leading edge of the novel flexible cutting die.

These and other aspects and attributes of the present invention will be discussed with reference to the following drawings and accompanying specification.

BRIEF DESCRIPTION OF THE DRAWINGS

FIG. 13A is a view of a cutting die in accordance with the present invention;

FIG. 13B is a view of an alternative cutting die of FIG. 13A in accordance with the present invention;

FIG. 13C is an elevational view of an alternate embodiment of the cutting die showing orifices formed therein;

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
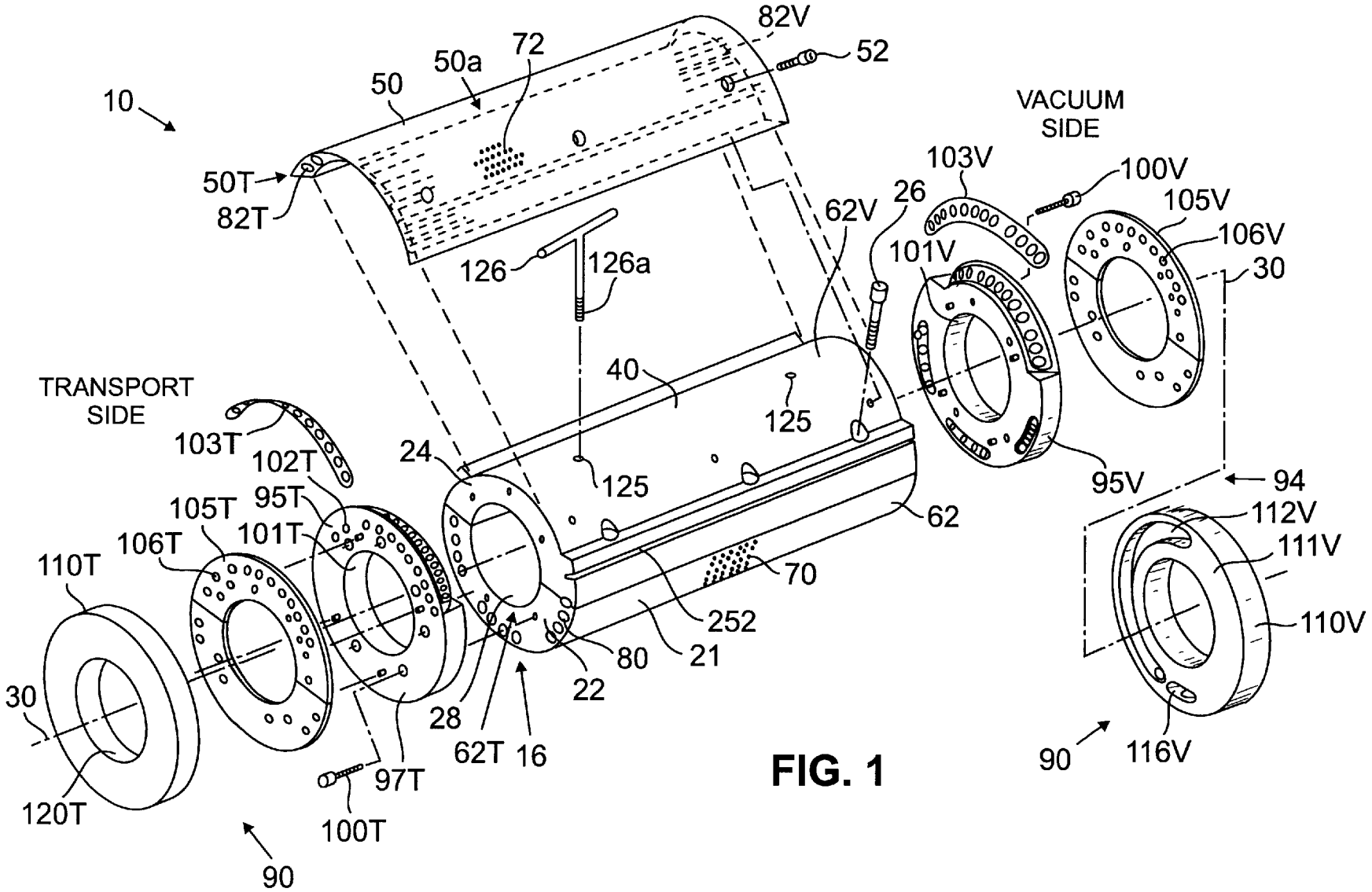
FIG. 1 is an exploded view of a rotary cutter assembly in accordance with the present invention.
Figure 2:
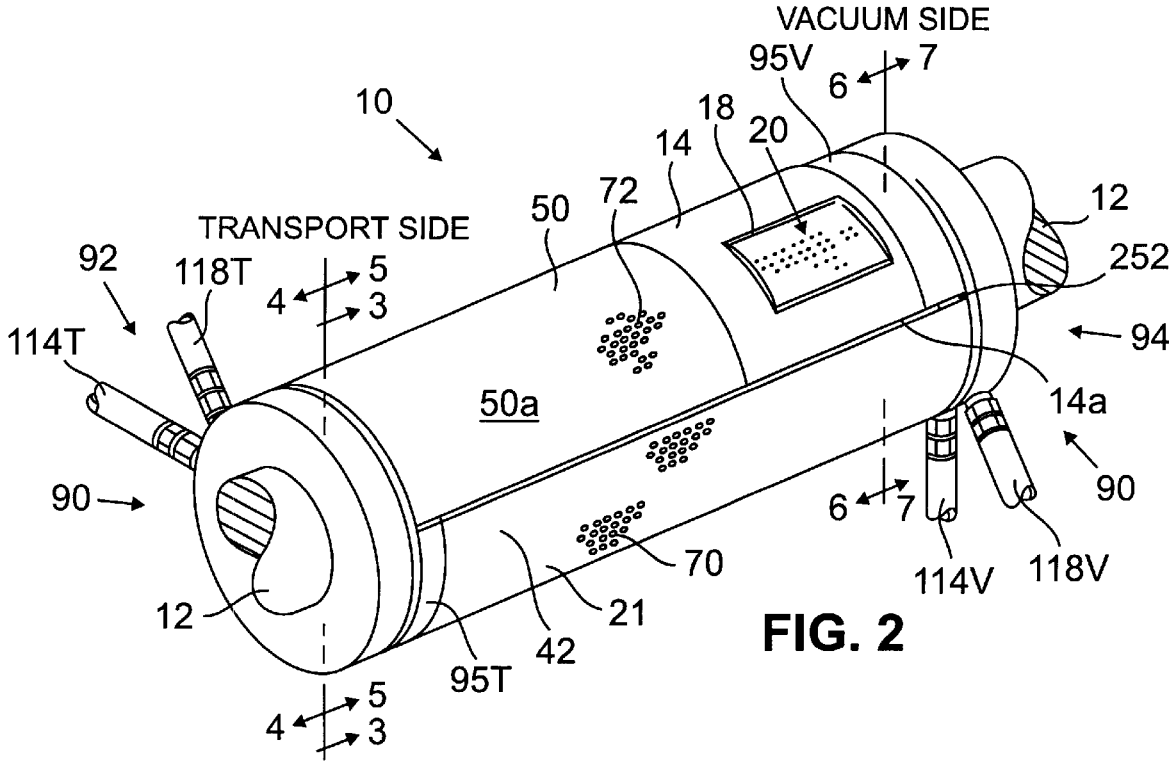
FIG. 2 is a perspective view of the assembled rotary cutter shown in FIG. 1.

Referring to the drawings and more particularly to FIGS. 1–2, an embodiment of a magnetic rotary cutting tool 10 for cutting panels P and the like from sheet-like material such as paper of predetermined relatively uniform thickness in blank or roll form to form products such as envelopes and the like is mounted on a drive shaft 12 in accordance with the present invention. The cutting tool 10 comprises a flexible cutting die 14 mounted on a die holder 16. The drive shaft 12 rotates the die holder 16 so that the cutting die 14 engages a different envelope blank B for each rotation of the die holder 16.

The die holder 16 cooperates with an air delivery assembly in order to receive and retain the envelope blank B during the cutting operation. One embodiment of an air delivery assembly is in accordance with U.S. Pat. No. 5,570,620, issued to the present inventor. The die holder 16 has a transport side which is generally depicted as the left side in FIGS. 1 and 2 and a vacuum side which is generally depicted as the right side. The transport side of the die holder 16 is adapted to receive vacuum or compressed air from the air delivery assembly 90 in order to retain and transport the envelope blank B as the die holder 16 rotates through the cutting operation. The vacuum side, in turn, is adapted to receive vacuum or compressed air from the air delivery assembly 90 in order to retain and carry the panel P cut from the envelope blank B adjacent to the die holder 16 until a predetermined position is reached wherein the panel P is released from the die holder 16. The suffix "t" and "v" will be used to denote the transport and vacuum sides, respectively, of the die holder 16. The structure and operation of the rotary cutting tool 10 is explained in greater detail below.

THE CUTTING DIE PLATE

Figure 3:
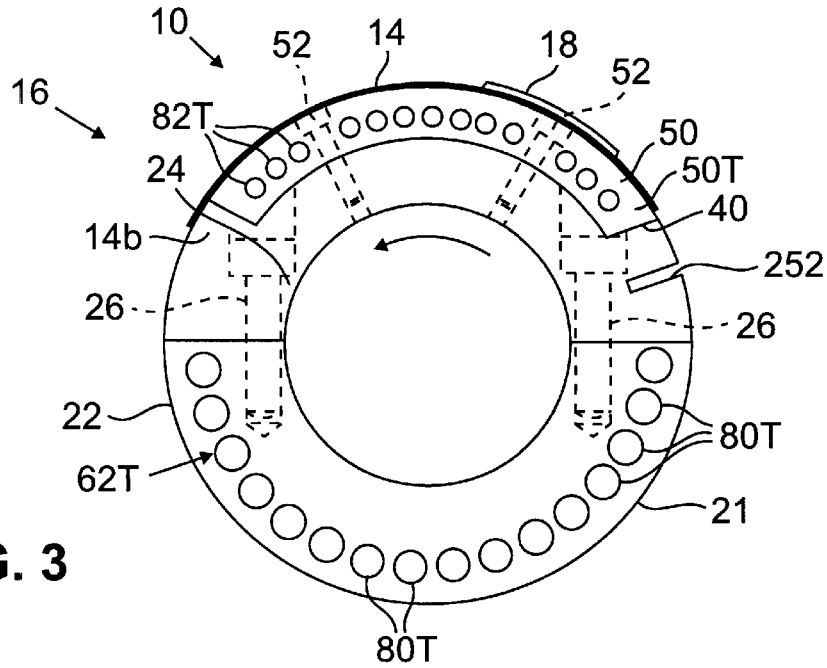
FIG. 3 is a sectional view of the transport face of the die holder taken along line 3—3 in FIG. 2.
Figure 4:
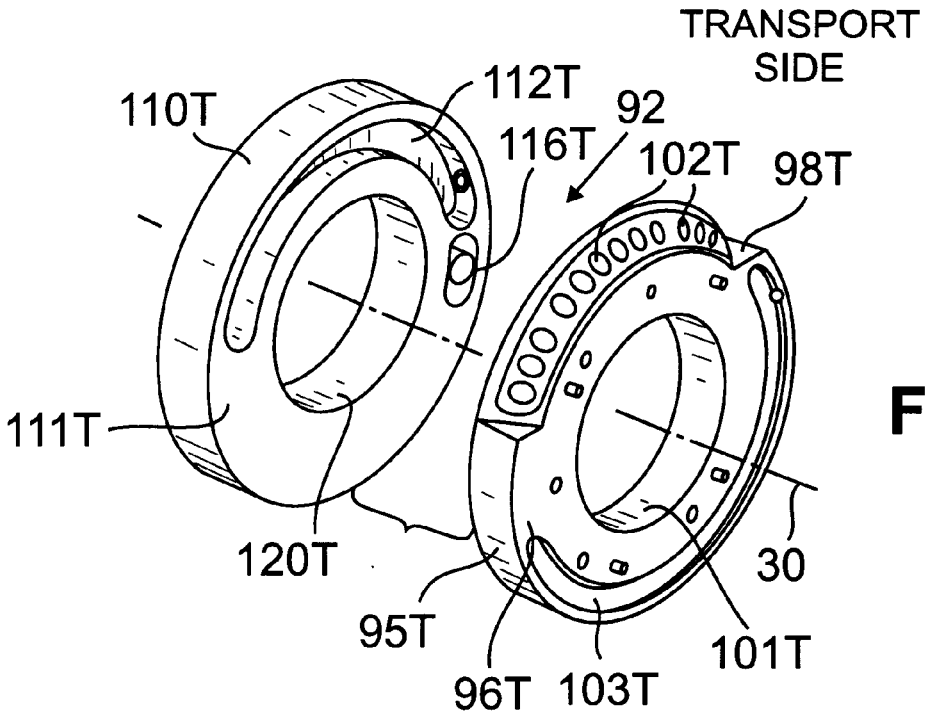
FIG. 4 is an exploded view of the connector die and the stationary plate (transport side) taken along line 4—4 in FIG. 2.
Figure 16:
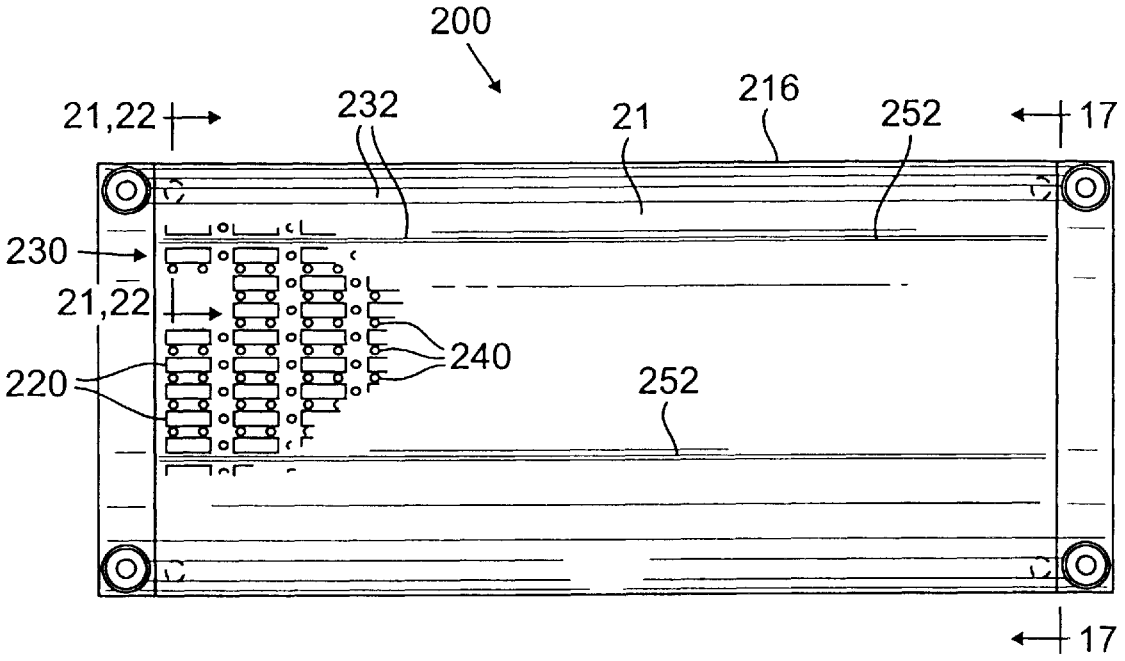
FIG. 16 is an elevational view of the magnetic die holder.

As shown in FIGS. 2, 3 and 16, the cutting die 14 has two opposing sides 14*a*, 14*b* for selectively and releasably attaching to the die holder 16. The cutting die 14 has a raised cutting edge 18 having a contour corresponding to the outline of the panel P to be cut in the envelope blank B or web. Although any other appropriate shapes may be used, the cutting edge 18, in the illustrated embodiment, has a rectangular contour to cut a rectangular panel P from the blank B.

The cutting die plate 14 may be manufactured from any suitable flexible magnetically compatible material including, for example, stainless steel, carbon steel or the like.

The cutting die 14 also includes a central opening 20 which is defined by the cutting edge 18. The cutting die opening 20 permits the die holder 16 and the air delivery assembly 90 to communicate with the envelope blank B through the cutting die 14 so that the die holder 16 may feed vacuum into the vicinity of the cutting edges 18 to retain the panel P in the cutting die 14 and to carry the panel P away from the blank B. Similarly, the opening 20 permits the die holder and the air delivery assembly 90 to feed compressed air into the vicinity of the cutting edges 18 so as to release the panel P from the cutting die 14 at an appropriate time.

Referring to FIG. 13*c*, the thickness H1 of the plate at surface 14*c* will typically be from about 0.003–0.060 inches, but may vary depending upon the application. Apertures 14*d* are formed in the cutting die 14 to allow the selective application of air or vacuum or both to the vicinity of the cutting edges 18. Operation of this feature of the present invention is set forth in detail hereinbelow.

THE CUTTING DIE HOLDER

The magnetic rotary die holder 16 is adapted for holding the cutting die 14 in selected positions around its magnetic outer surface 21. As best shown in FIG. 1, the die magnetic holder 16 is formed by two semi-cylindrical magnetic sections 22 and 24 which are attached to each other by bolts 26 so as to define a cylindrical shape and a central bore 28 adapted to receive the drive shaft 12. The die holder 16 has a longitudinal axis 30 generally extending along the axis of the drive shaft 12. As best shown in the FIG. 3, the illustrated die holder 16 is adapted to rotate in a counter clockwise direction as shown by the arrow. The die holder 16 utilizes magnetic members disposed about the outer surface, for retaining the cutting die 14 as hereinbelow described in detail.

Referring to FIGS. 1 and 3, the section 24 has one large channel 40 extending along the axis 30. The channel 40 is adapted to receive an arcuate cover plate 50 having an outer surface face 50*a*. In the embodiment of the cover plate 50 best illustrated in FIGS. 1, 5, 6 and 15, the feed tubes 82 extend through the entire length of the cover plate and open to both the transport face 50*t* and the vacuum face 50*v* of the cover plate 50 so that the opposing openings 82*t*, 82*v* of the feed tube 82 communicate with the transport and vacuum sides.

THE CYLINDRICAL BODY

Turning first to the two cylindrical sections 22, 24, it will be seen in FIGS. 1 and 2 that exterior surface of the two sections 22, 24 which engage the envelope blank B have a plurality of orifices 70, 72 disposed thereon respectfully which radially communicate with a plurality of corresponding feed tubes 80 subjacent the surface 21 of the die holder 16. Each feed tube 80 is generally parallel to the longitudinal axis 30 of the die holder 16 and have openings 80*t* and 80*v* in the transport and vacuum sides 62*t*, 62*v* of the die holder 16. A sealing gasket may be disposed between the section 22, 24 to provide an airtight seal.

Each feed tube 80 is adapted to communicate with the air delivery assembly 90 so that vacuum may be supplied to the feed tubes 80 so as to create a vacuum in the corresponding orifices 70 and retain the envelope blank B or panel P adjacent to the surface 21 of the corresponding orifices 70. Conversely, supplying compressed air to the feed tubes 80 will blow air through the corresponding orifices 70 and release the envelope blank B or panel P.

By selectively sealing the proper side of the feed tube 80, the operator may select whether the individual feed tube 80 (and the corresponding orifices 70) communicates with either the transport or the vacuum side of the air delivery assembly 90. In applications where the envelope blank B is adjacent to the certain predetermined orifices 70 and it is desired to retain the envelope blank adjacent the die holder 16, the transport side 80*t* of the feed tubes 80 corresponding to the predetermined orifices 70 are left open so that the feed tubes 80 communicate with the transport side of the air delivery assembly 90 whereas the vacuum side 80*v* is sealed.

Conversely, if the panel P is adjacent to the predetermined orifices 70, the vacuum side 80*v* of the feed tubes 80 corresponding to the predetermined orifices 70 are left open so that the feed tubes 80 communicate with the vacuum side of the air delivery assembly 90 whereas the transport side 80*t* are sealed.

As best seen in FIG. 3, it is preferable that the walls defining the feed tubes 80 are separate from the drive shaft 12 so that any abrasion or other wear to the drive shaft 12 or the central bore 28 will not affect the vacuum seal in the feed tubes 80. Similarly, an insufficient seal in one of the feed tubes 80 will not affect the other separate feed tubes 80.

THE AIR DELIVERY ASSEMBLY

In accordance with certain objects of the invention, a novel air delivery assembly 90 is provided for supplying vacuum or compressed air to the die holder 16. The air delivery assembly 90 comprises a transport assembly 92 and a vacuum assembly 94. The transport assembly 92 is adapted to feed vacuum to the die holder 16 in order to retain the envelope blank B adjacent to the die holder 16 and "transport" the envelope blank B as the holder 16 rotates through the cutting operation. The vacuum assembly 94, in turn, is adapted to feed vacuum to the die holder 16 in order to retain the panel P cut from the envelope blank B adjacent to the die holder 16 until a predetermined position is reached wherein the panel P is released from the die holder 16. At predetermined positions, the transport and vacuum assemblies 92, 94 may feed compressed air to the die holder 16 in order to release the envelope blank B and the panel P, respectively.

In accordance with one aspect of the invention, the air delivery assembly comprises a stationary plate disposed at least at one end of the die holder and defining a groove member for selectively supplying vacuum and/or air. The die holder is operatively connected to the stationary plate so that a supply of vacuum or air is selectively supplied at the surface orifices of the die holder when rotation of the die holder aligns the longitudinal feed tubes with the groove member.

In the embodiment illustrated FIGS. 1–2, the right and left sides of the die holder 16 are designated as the vacuum and transport sides, respectively. The same reference numeral with the suffix "v" and "t" will be used to denote the similar components of the air delivery assembly 90 which are located in both the transport assembly 92 and the vacuum assembly 94, respectively.

THE VACUUM ASSEMBLY

Figure 7:
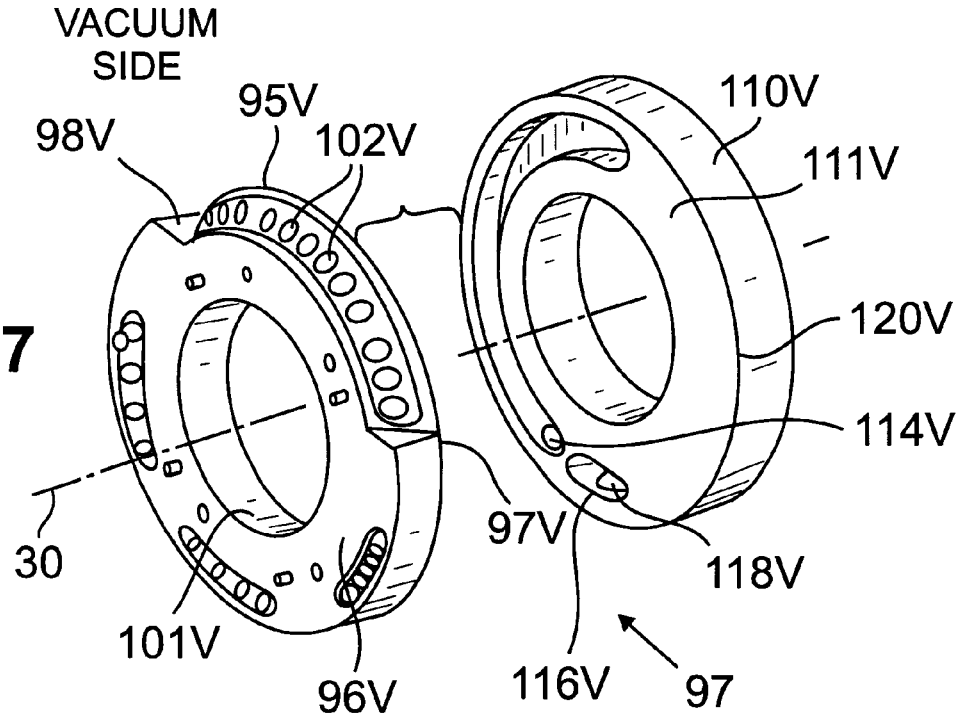
FIG. 7 is an exploded view of the connector plate and the stationary plate (vacuum side) taken along line 7—7 in FIG. 2.

Referring to the vacuum assembly 94 in FIGS. 1 and 7, it will be seen that the vacuum assembly 94 comprises a rotary connector plate 95*v* which is attached to and rotate in unison with the die holder 16, a stationary plate 110*v* fixed to the panel cutting machine 10, and an interface seal 105*v* which is disposed between the connector plate 95*v* and the stationary plate 110*v* to form a substantially airtight seal.

The connector plate 95*v* has an interior side 96*v* adapted for matedly engaging the vacuum side 62*v* of the die holder 16 and an exterior side 97*v* adapted for engaging the interface seal 105*v*. The connector plate 95*v* has a central bore 101*v* for receiving the drive shaft 12. Since the inclined cover plate side 50*v* projects outwardly from the vacuum side 62*v* of the die holder 16, the interior side 96*v* of the connector plate 95*v* has inclined inset 98*v*, adapted to receive and engage the cover plate 50. When the cover plate 50 is attached to the cylindrical sections 22, 24 and the screws 52 are tightened, the force exerted by the inclined face 50*v* on the inclined insets 98*v* assists in forming a substantially airtight seal.

In order to communicate vacuum and compressed air to the die holder 16, the connector plate 95*v* has a plurality of holes 102*v* corresponding to any feed tubes, including for example feed tubes 80, 82 in the die holder 16. As shown in FIG. 1, it is preferable to have a plastic or rubber gasket seal 103*v* disposed between the holes 102*v* and the feed tubes 80, 82, to insure that an airtight seal is created between the metal die holder 16 and connector plate 95*v*.

Once the connector plate 95*v* is properly aligned with the die holder side 62, the connector plate 95*v* and the die holder side 62 are attached together using screws 100*v*. It will be appreciated that the die holder 16 and the connector plate 95*v* rotate in unison together.

Although any suitable metals or other materials may be used, it wilt be appreciated that the connector plate 95*v* and the stationary plate 110*v* are typically machined from aluminum, therefore, direct contact between the rotating connector plate 95 and the stationary plate 110 is abrasive. In order to reduce such abrasion, the interface seal 105*v* is disposed between the connector plate 95 and the stationary plate 110. The interface seal 105*v* has a plurality of openings generally designated as 106*v* in FIG. 1 which correspond with the holes 102*v* in the connector plate 95*v*.

The interface seal 105V has a plurality of openings generally designated as 106V in FIG. 1 which correspond with the holes 102V in the connector plate 95V.

The interface seal 105*v* may be attached to either the connector plate 95*v* or the stationary plate 110*v* although in the illustrated embodiment, the interface seal 105*v* is attached to the connector plate 95*v* using screws 100*v*. Although any suitable abrasion and temperature resistant material may be used, it has been found that manufacturing the interface seal 105*v* from a plastic known under the trade name RULON® manufactured by Furon Advanced Polymers is satisfactory. The plastic interface seal 105*v* may be easily replaced if it wears out so that the physical integrity of the expensive machined connector plate 95*v* may be maintained.

The stationary plate 110*v* has an interior side 111*v* adapted to engage the interface seal 105*v*. The interior side 111*v* defmes a vacuum groove 112*v* which is in communication with a vacuum source (not shown) via vacuum hose 114*v*, an air supply groove 116*v* which is in communication with a compressed air source (not shown) via air hose 118*v*, and a central bore 120*v* adapted to rotatably receive the drive shaft 12.

As the connector plate 95*v* rotates relative to the stationary plate 110, the connector plate holes 102*v* rotate and sequentially communicate with the vacuum and air grooves 112*v*, 116*v*. When the connector plate openings 102*v* and thus, the corresponding feed tubes 80, 82, in the die holder 16 are an communication with the vacuum groove 112*v*, the vacuum source is supplied to the corresponding orifices in communication with the feed tubes. Similarly, when the openings 102*v* are in communication with the air supply groove 116*v*, compressed air is supplied to the corresponding orifices in the surface 21 of die holder 16. Thus, it will be appreciated that extremely precise timing of the vacuum and compressed air may be supplied to the die holder 16 by adjusting the configuration and position of the vacuum groove 112*v* and the air groove 116*v*.

The interface seal 105*t*, disposed between the connector plate 95*t* and the stationary die 110*t* is identical with the interface seal 105*v* associated with the vacuum assembly except that its physical configuration will correspond with the holes 102*t* and bore 101*t*. In an analogous fashion, references to 96T, 97T, 98T, 100T, 101T, 102T, 103T, 105T, 106T, 111T, 114T, 116T, 118T and 120T are transport-side instances identical to their respective vacuum-side instances 96V, 97V, 98V, 100V, 101V, 102V, 103V, 105V, 106V, 111V, 114V, 116V, 118V and 120V, except that their physical configurations will correspond to the transport side of rotary cutting tool 10.

Referring to FIG. 2, it will be appreciated that the cutting die 14 will be disposed along the periphery of the die holder 16. In order for the vacuum assembly 94 to feed vacuum or compressed air to the die opening 20 defined by the cutting edge 18, the operator selects the specific feed tubes which correspond with the orifices within the opening 20. The vacuum side of these feed tubes are left open so that they may communicate with the vacuum assembly 94 and the panel P cut by the cutting die 14 may be retained. On the other hand, the other feed tubes which do not communicate with the cutting die opening 20 or the panel P are sealed so that they do not communicate with the vacuum assembly 94. Any feed tube in the die holder 16 may be sealed at the vacuum side 62*v* of the die holder or at the corresponding connector plate holes 102*v* using any appropriate method including, for example, plugs, tape or the like.

As the die holder 16 and the connector plate 95*v* rotate relative to the stationary plate 110*v*, the open feed tubes sequentially communicate with the vacuum groove 112*v* and the air groove 116*v*. When the appropriate feed tube communicates with the vacuum groove 112*v*, vacuum is supplied to the surface 21 of the die holder 16 and the cutting die 14 so as to retain the panel P cut from the blank B within the die opening 20. Similarly, compressed air is supplied to the surface 21 of the die holder 16 and the cutting die 14 so as to blow the panel P from the cutting die 14 when the open feed tubes communicate with the air groove 114*t*.

THE TRANSPORT ASSEMBLY

Figure 5:
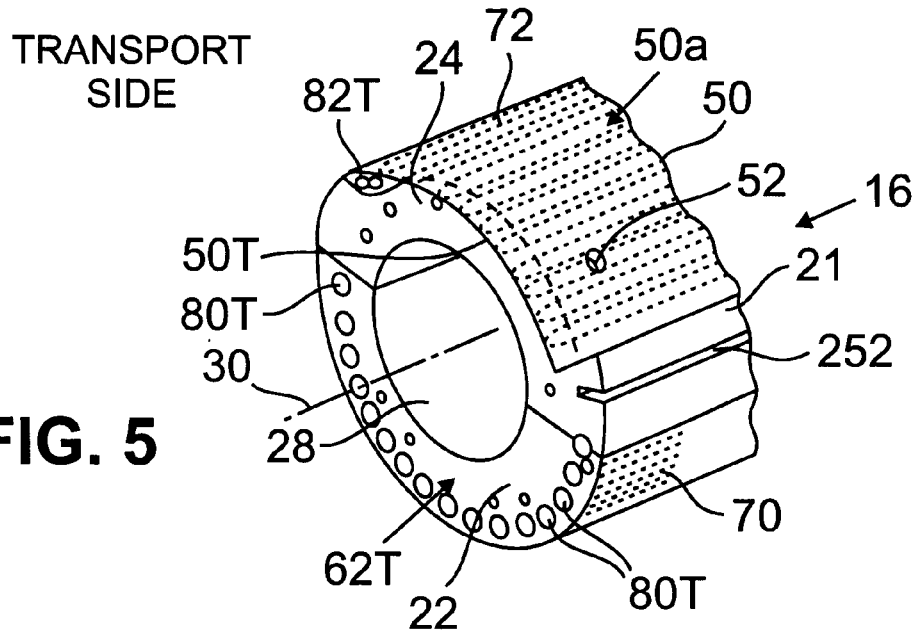
FIG. 5 is a perspective view of the transport face of the die holder taken along line 5—5 in FIG. 2.
Figure 6:
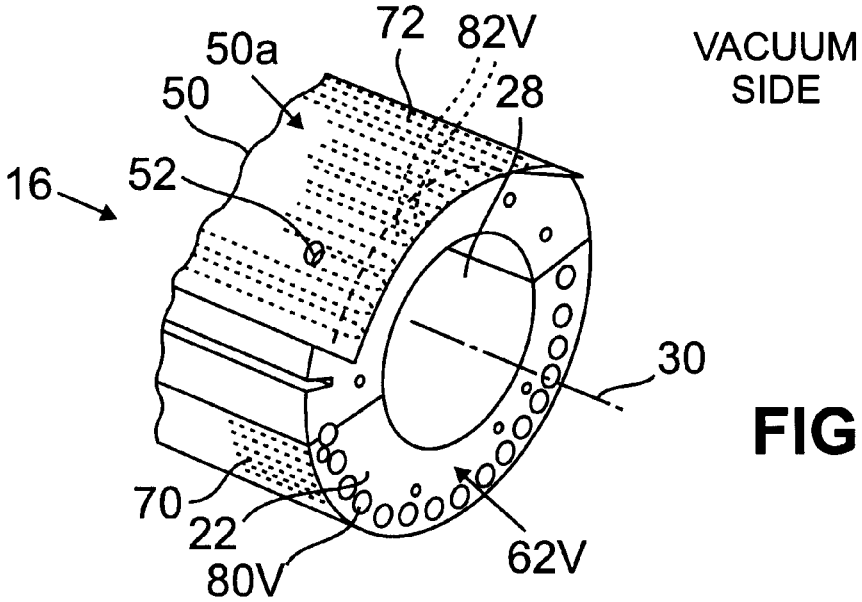
FIG. 6 is a perspective view of the vacuum face of the die holder taken along line 6—6 in FIG. 2.

The transport assembly 92, illustrated in FIGS. 1 and 5, is similar to the vacuum assembly 94 except that it is used to retain the envelope blank B instead of the panel P adjacent to the die holder surface 21.

During the cutting operation, it will be appreciated that the envelope blank B will be disposed adjacent the periphery of the die holder 16 so that certain orifices and the corresponding feed tubes will communicate with the envelope blank B. In order for the transport assembly 92 to feed vacuum or compressed air to the envelope blank B, the operator preselects the orifices and feed tubes which communicate with the envelope blank B. The transport side of feed tubes which communicate with the envelope blank B are left open. The other feed tubes which do not communicate with the envelope blank B are sealed.

As the die holder 16 and the connector plate 95*t* rotate, the open feed tubes communicate with the vacuum groove 112*t* and the air groove 116*t* in the stationary plate 110*t*. When the connector plate openings 102*v* are aligned and communicate with the vacuum groove 112*t*, vacuum is supplied to the surface 21 of the die holder 16 so as to retain the envelope blank B in the desired position. Similarly, compressed air is supplied to the surface 21 of the die holder 16 so as to release the envelope blank B from the die holder 16. Since the feed tubes which do not communicate with the envelope blank B are sealed the transport assembly does not feed vacuum or compressed air thereto.

Since the vacuum assembly 94 acts to control the release of the panel P cut from the envelope blank B whereas the transport assembly 92 acts to control the release of the envelope blank B, it will be appreciated that the configuration and position of the vacuum and air grooves 112, 116 in the vacuum and transport assemblies 94, 92 will vary with the position and size of the die cutter 10 and the size and position of the envelope blank B. Similarly, although the air delivery assembly 90 has been described with respect to the illustrated embodiments of the feed tubes associated with the illustrated die holder 16, the number, configuration and radially position of the feed tubes may be varied as long as the feed tubes are capable of communicating with the vacuum and air grooves in the air delivery assembly during the die holder's rotation.

OPERATION

In operation, the rotary cutter 10 is adapted to be installed on a conventional drive shaft 12. Typically, the cylindrical sections 22 and 24 may be disposed so that the bore 28 engages the shaft 12 and the screws 26 are tightened to attach the sections 22 and 24 about the shaft 12. The cutting die 14 may be attached to the cylindrical sections 22 and 24 as previously explained.

Figure 8A:
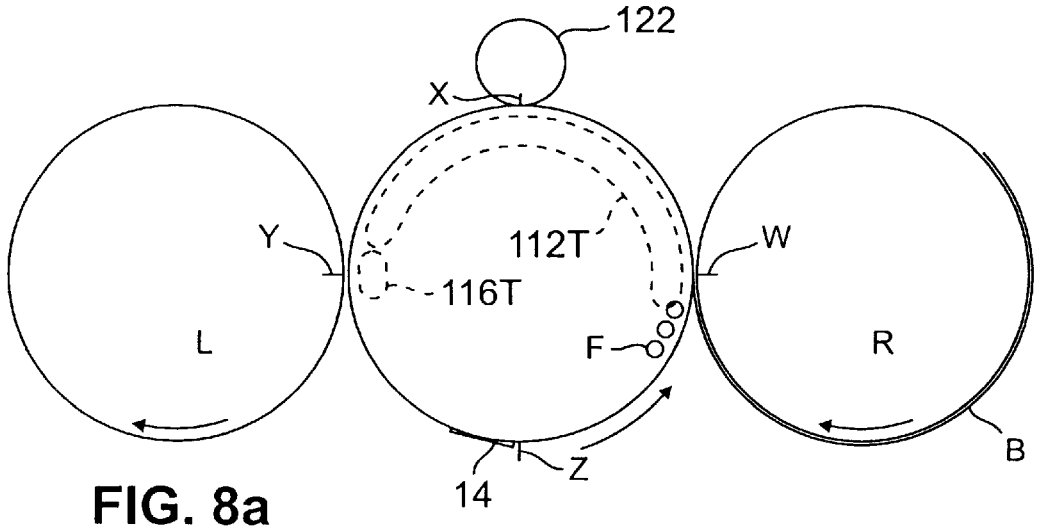
FIG. 8A illustrates the position of the rotary cylinder as transfer cylinder R feeds an envelope blank to the die holder.
Figure 8B:
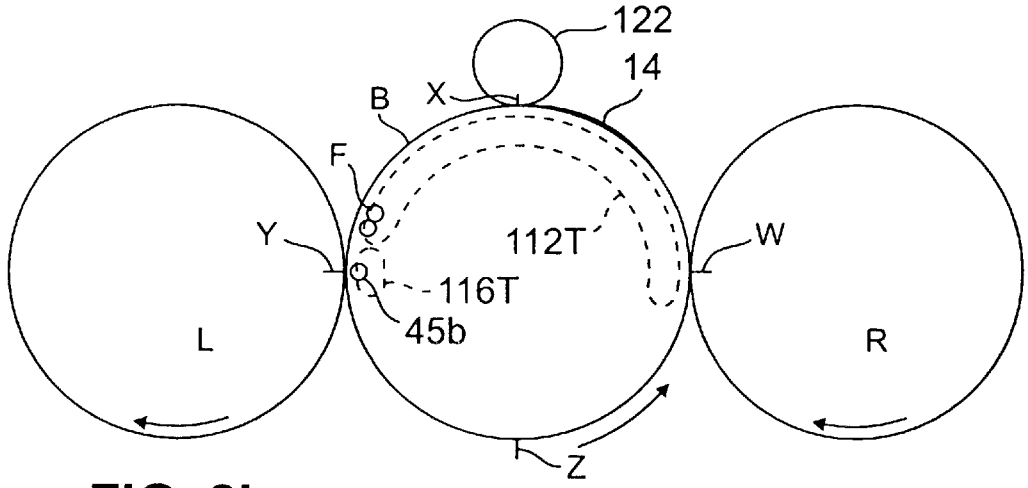
FIG. 8B illustrates the position of the rotary cutter as a panel is cut from the envelope blank.
Figure 8C:
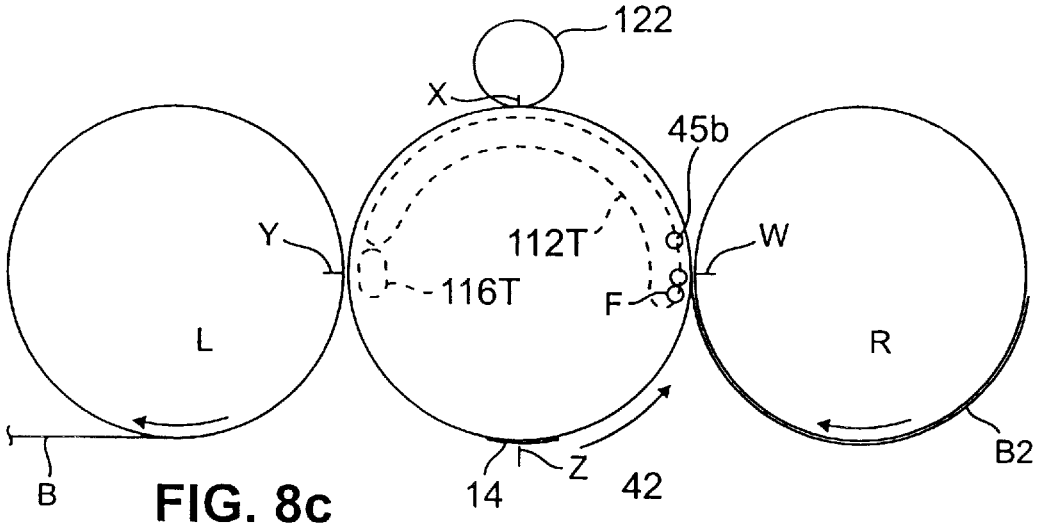
FIG. 8C illustrates the position of the rotary cutter as the envelope blank is released to transfer cylinder L and the die holder receives another envelope blank from transfer cylinder R.
Figure 9A:
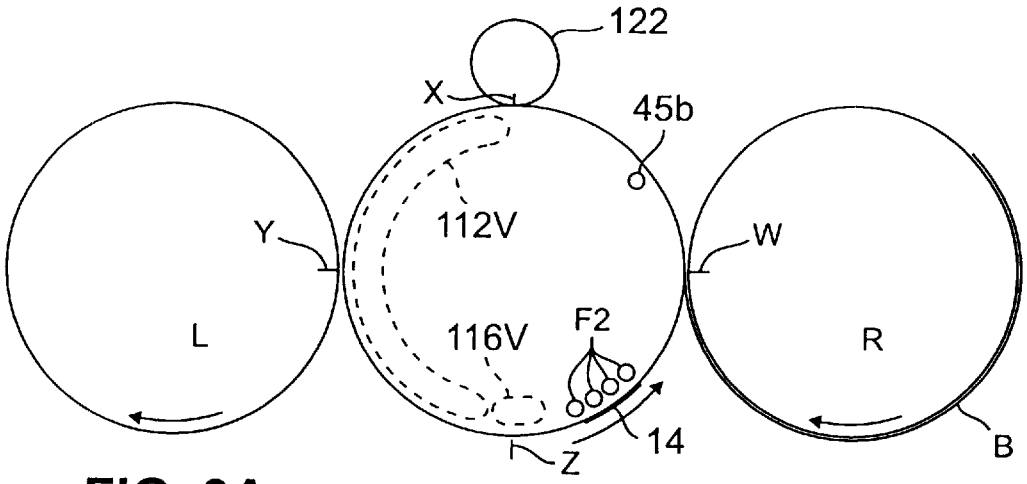
FIG. 9A illustrates the position of the rotary cylinder as transfer cylinder R feeds an envelope blank to the die holder.
Figure 9B:
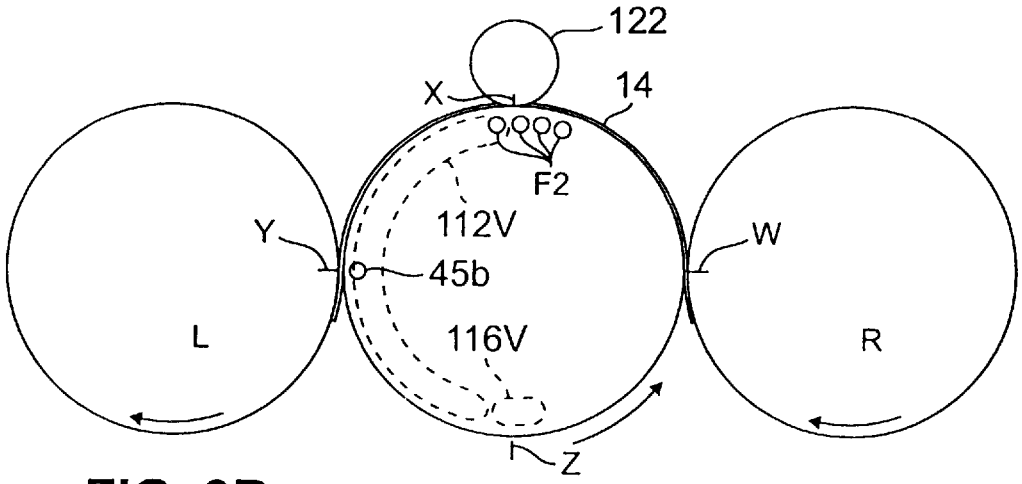
FIG. 9B illustrates the position of the rotary cutter as a panel is cut from the envelope blank.
Figure 9C:
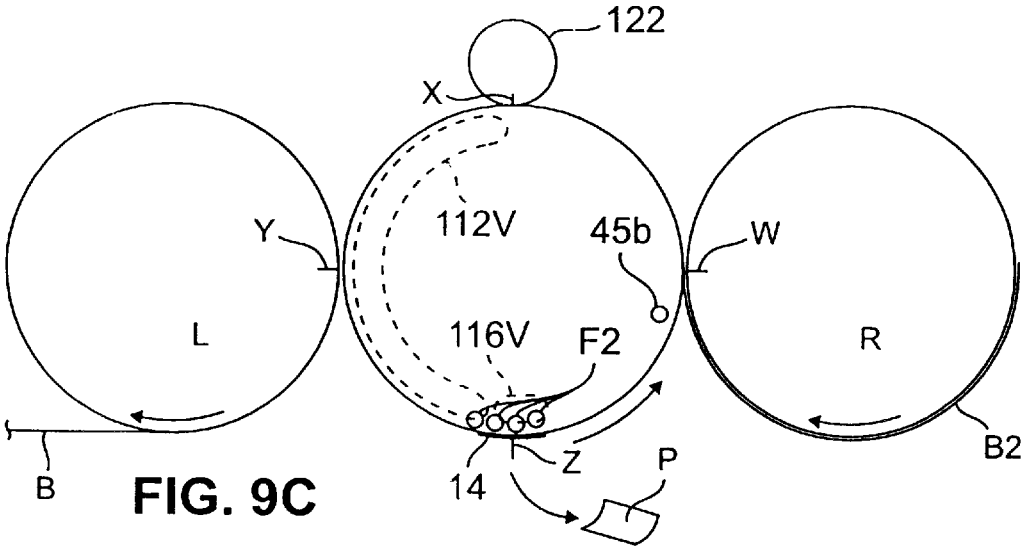
FIG. 9C illustrates the position of the rotary cutter as the envelope blank is released to transfer cylinder L and the die holder receives another envelope blank from transfer cylinder R.

Although any type of conveyor assembly may be used which moves the envelope blanks B in serial order to the rotary cutter 10 which cuts out the panels P, in the illustrated embodiment, the conveyor system comprises a cylinder R which delivers the uncut envelope blank B to the rotary cutter 10 and a cylinder L which transports the cut envelope blank B away from the rotary cutter 10. In the embodiments illustrated in FIGS. 8A–9C, cylinders L and R are rotating in a clockwise direction and the rotary cutter 10 is rotating in a counter clockwise direction, although the rotation may be varied depending upon the particular application. FIGS. 8A–*c* illustrate the operation of the transport assembly 92 and FIGS. 9A–*c* illustrate the operation of the vacuum assembly 94 as viewed along the longitudinal axis 30 and from left (transport) side of the die cutter 10 as shown in FIG. 2.

Turning first to FIGS. 8A–*c* which schematically illustrate the operation of the transport assembly 92, it will be seen that the top portion of the stationary plate 110*t* contains the vacuum groove 112*t* and the air groove 116*t* depicted by the broken lines. The transfer cylinder R delivers the envelope blank B at transfer point W between the die holder 16 and cylinder R. It will be appreciated that the feed tubes F and the corresponding orifices which communicate with the transport assembly 92 are subjacent the envelope blank B and do not communicate with the panel P Which is cut from the blank B. Any feed tubes which communicate with the panel P are sealed to the transport assembly 92.

As the die holder 16 rotates, the feed tube 45*b* and the envelope blank B pass between the cutting bar 122 and the die holder 16 (point X) but since the cutting die 14 is not present, the envelope blank B passes through without being cut. The feed tube 45*b* continues to communicate with the vacuum groove 112*t* until the end of the vacuum groove 112*t* at which point the envelope blank B is ready to be transferred to the transfer cylinder L as shown in FIG. 8B at point Y. When the feed tube 45*b* exits the vacuum groove 112*t* and enters into the air groove 116*t*, the vacuum to the feed tube 45*b* and corresponding orifices 45*c* is terminated and compressed air is fed to thereto which acts to release the envelope blank B. Simultaneously, the transfer cylinder L applies a vacuum which transfers the envelope blank B from the die holder 16 to cylinder L.

The transport assembly 92 continues to rotate to the transfer cylinder R to obtain the next successive envelope blank B2 at point W as shown in FIG. 8C.

Turning next to FIGS. 9A–c which schematically illustrate the operation of the vacuum assembly 94, it will seen that the vacuum groove 112*v* and the air groove 116*v* are disposed in the left portion of the die holder 16. The transfer cylinder R first delivers the envelope blank B to the transfer point W between the die holder 16 and cylinder R. On the other hand, the feed tubes, generally depicted as F2, which are subjacent the opening 20 of the cutting die 14 are in communication with the vacuum assembly 94.

As the die holder 16 rotates, the feed tubes F2 and the cutting die 14 engage the envelope blank B at point W. The feed tubes F2 remain inactive because they are not in communication with the vacuum or air grooves 112*v*, 116*v* of the vacuum assembly 94.

As shown in FIG. 9B, when the envelope blank B passes between the cutting bar 122 and the cutting die 14 at point X, the panel P is cut from the envelope blank B. The illustrated cutting bar 122 is a stationary bar but those skilled in the art would ascertain that other embodiments may be used, including, for example, rotary cutting bars or anvils, square or circular cutting bars and the like. At point X, the feed tubes F2 communicate with the vacuum groove 112*v*. The vacuum source feeds vacuum to the feed tubes F2 and the corresponding orifices which are within the opening 20 of the cutting die 14. The vacuum retains the panel P adjacent the outer surface 21 of the die holder 16.

As the die holder 16 continues to rotate, the feed tube 45*b* reaches the transfer point Y with cylinder L and the envelope blank B is transferred to cylinder L. The cutting die 14 subsequently reaches the transfer point Y, but the feed tubes F2 remain in communication with the vacuum groove 112*v* so that the panel P is not released from the die holder 16.

As shown in FIG. 9C, the die holder 16 continues to rotate until the cutting die 14 reaches point Z wherein the feed tubes F2 leave the vacuum groove 112*v* and enter the air groove 116*v*. The air groove 116*v* feeds compressed air to the feed tubes F2 which subsequently releases the panel P into a scrap collection bin for later disposal.

In order to assist the disassembly of die holder 16 from the drive shaft 12, the cylindrical section 22 may have a plurality of holes 125 which cooperate with a screw handle 126. When the screw handle 126 is screwed into the holes 125, the tip 126*a* of the handle 126 creates space between the cylindrical sections 22, 24 and the drive shaft 12 which enables the operator to easily disengage the die holder 16 therefrom. The handle tip 126*a* may be made from a relatively soft metal such as brass or the like which will not damage the drive shaft 12. The screw handle 126 may also be used to carry the die holder 16. The magnetic clamp assemblies 200 retain and hold the cutting die 14 adjacent to the die holder surface 21 as illustrated in FIGS. 16–27. FIGS. 16A and 16B illustrate embodiments of cutting dies 202, 204 which are adapted to be used in conjunction with the magnetic die holder 216.

In the embodiment illustrated in FIGS. 14–23, a plurality of recesses 218 are formed in the die holder 216 for receiving individual magnets 220 having exposed faces 220*a*. In the embodiment illustrated in FIGS. 24 and 25, the die holder 316 has a plurality of longitudinally extending grooves 318, each groove 318 being adapted to receive an insert 320. Each insert 320 has a plurality of recesses 322 for receiving individual magnets 220. It has been found that it is easier to manufacture and machine the recesses 322 in the insert, rather than the relatively large and bulky die holder, and subsequently install the insert 320 in the die holder 316.

Figure 17:
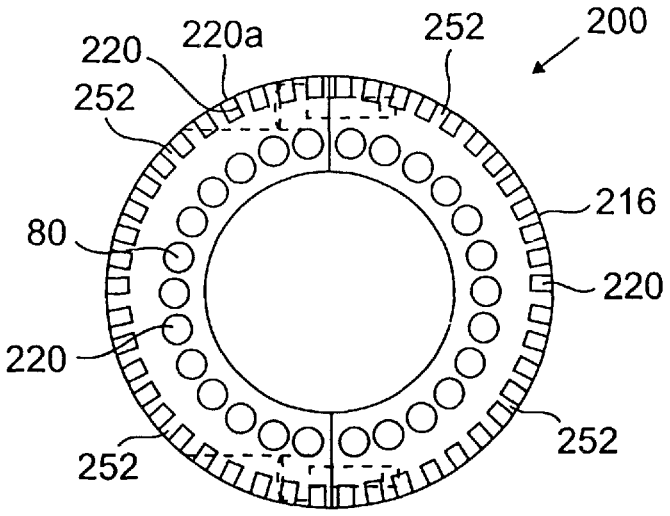
FIG. 17 is a view of the die holder taken along line 20—20 in FIG. 16.
Figure 18:
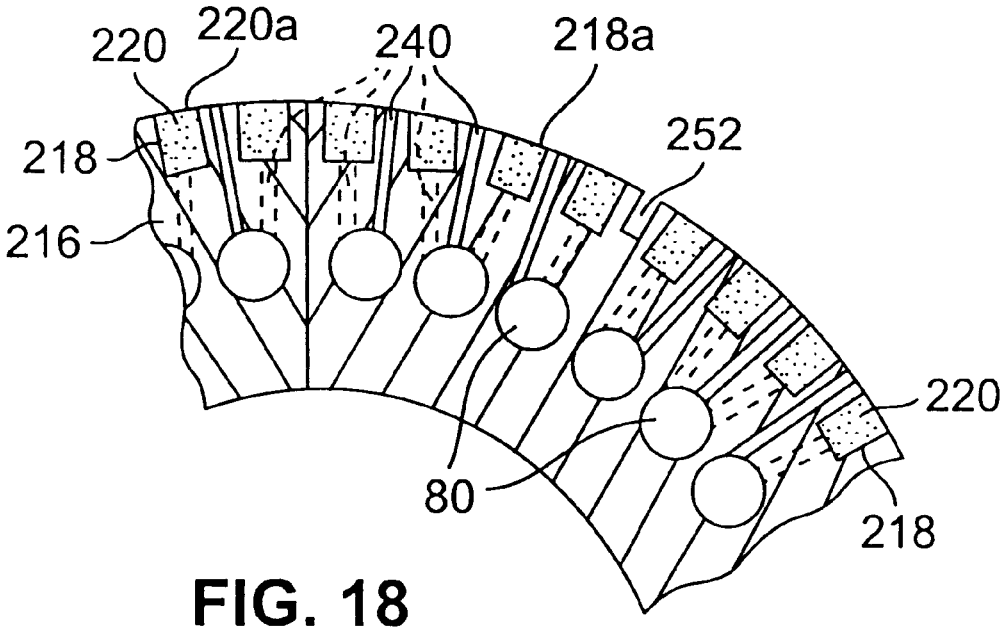
FIG. 18 is a view of the die holder taken along line 21—21 in FIG. 16.
Figure 19:
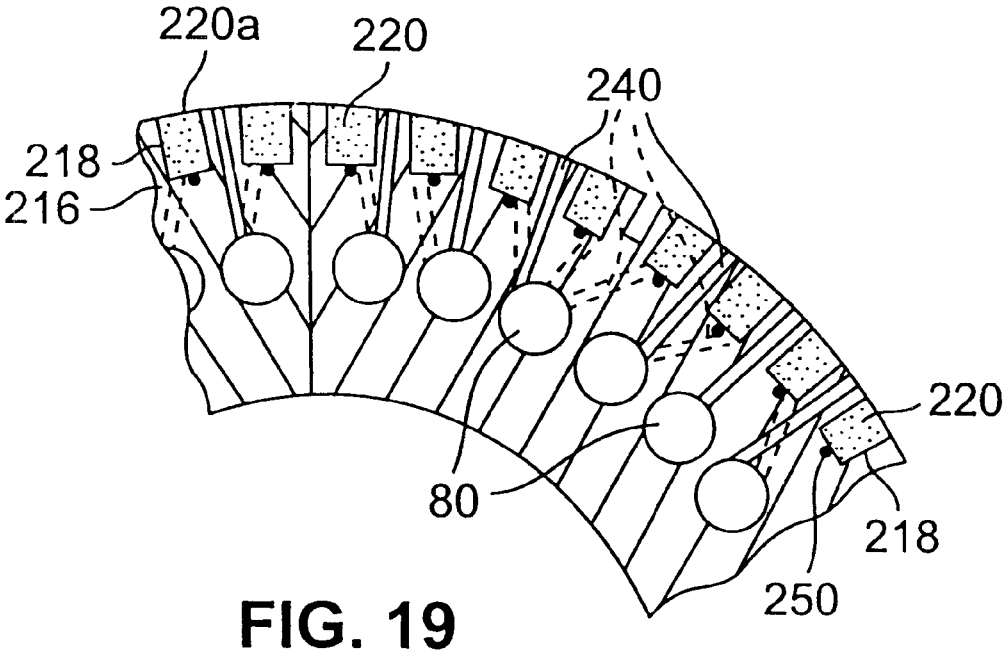
FIG. 19 is a view of the die holder taken along line 22—22 in FIG. 16.

As shown in FIGS. 17–19, the outer surface of the magnets 218*a* are flush with die holder surface 21. Although the dimensions of the magnets may be varied depending upon the application, it is preferred that the width be from about 0.125 to about 0.25 inches, the length from 0.375 to about 0.75 inches, and the height from about 0.175 to about 0.25 inches.

As soon as the cutting die 14 is brought near the die holder surface 21, the magnets 220 attract the thin metal cutting die 14. The cutting die 14 is, thus, magnetically retained adjacent to the surface 21 of the die holder 16. The magnetic force will flatten the entire area of the cutting die 14 against the die holder surface 21 so that there is no slack present between the die holder surface 21 and the cutting die 14. The cutting die 14 is positioned and orientated so that it properly cuts the envelope blanks B.

A plurality of air orifices 240 are disposed in the die holder surface to retain the envelope blank B and the panel P adjacent to the die holder surface 21. The air orifices 240 are in radial communication with the plurality of corresponding air feed tubes 80. The feed tubes 80 and the corresponding orifices 240 may be connected to the novel vacuum and compressed air delivery system described above or to a conventional source of vacuum and compressed air (not shown).

It is generally preferred to maximize the number and distribution of the orifices 240 while minimizing the number and distribution of the expensive magnets 220. Thus, it is preferred that at least some orifices 240 be disposed between substantially all of the adjacent magnets 220 in order to maximize the distribution and effect of the orifices 240, thereby permitting the cutting die 14 to be placed anywhere on the die holder surface 21 and the panel P cut from the blank B to be retained during the cutting operation. It will be appreciated that any number of orifices may be disposed between adjacent magnets.

In the embodiment illustrated in FIGS. 14–16, 21, and 23, the recesses 218 and the magnets 220 are disposed in parallel, horizontal rows 230 and columns 232 such that the longitudinal axis of the columns 232 in each adjacent row 230 are aligned with each other. In the embodiment illustrated in FIG. 18, the recesses 218 and magnets 220 are disposed in parallel, horizontal rows 230 and columns 234 such that the longitudinal axis of columns 234 in each adjacent row 230 are offset relative to each other.

Substantially all of the rows 230 have orifices 240 disposed between substantially all of the adjacent magnets 220. Similarly, it is preferred that the die holder 216 have alternating rows 230 of magnets 220 and orifices 240 and alternating columns 232, 234 of magnets 220 and orifices 240.

It should now be appreciated that the illustrated embodiments maximize the ability of the die opening 20 to communicate with orifices 240 wherever the cutting die 14 is disposed on the die holder surface 21. In contrast, many conventional magnetic die holders which have alternating rows of magnets and orifices or alternating columns of magnets and orifices tend to limit the placement of the cutting die 14 because the die holder may have an insufficient number orifices in the vicinity of the die opening 20 for retaining the panel P.

Figure 23:
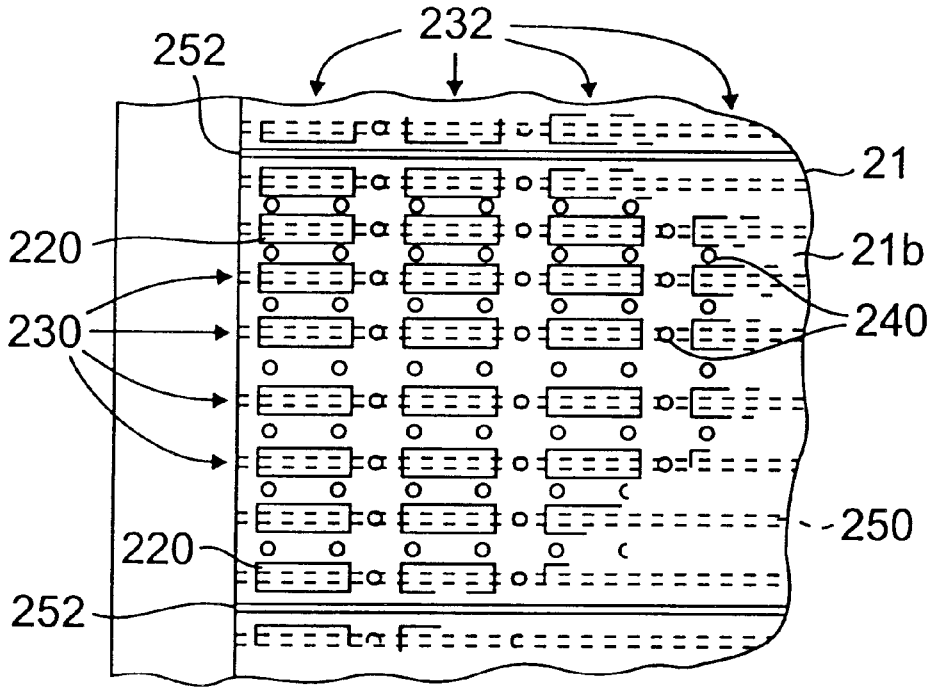
FIG. 23 is another view of the magnetic die holder illustrated in FIG. 21.
Figure 24:
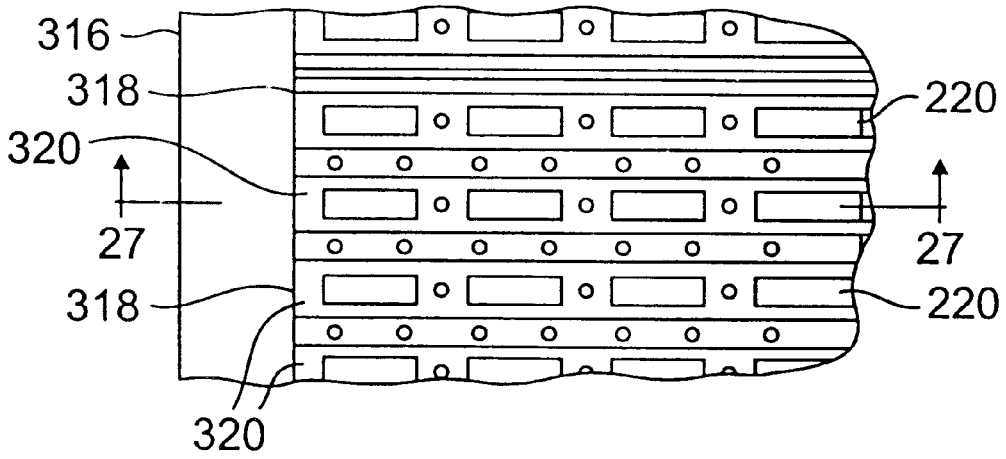
FIG. 24 is a view of another embodiment of a magnetic die holder.
Figure 25:
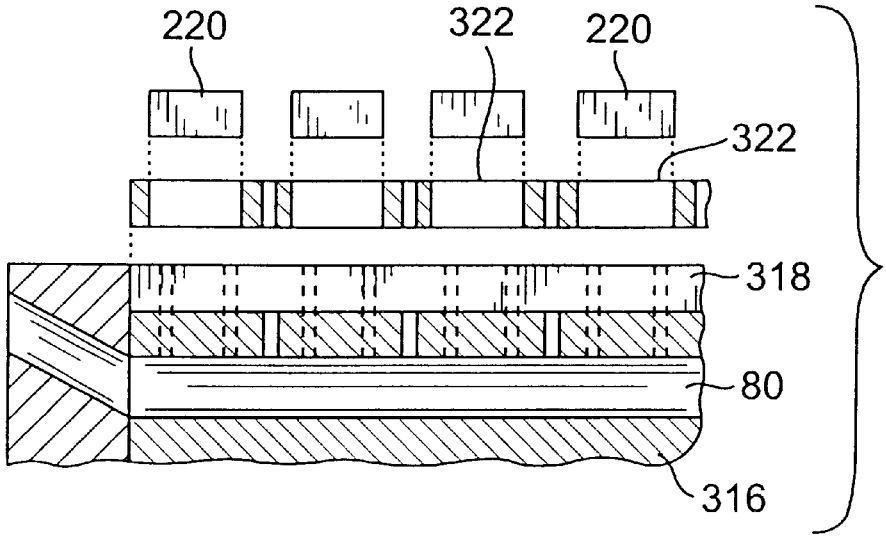
FIG. 25 is an exploded view of the magnetic die holder taken along line 27—27 in FIG. 24.
Figure 26:
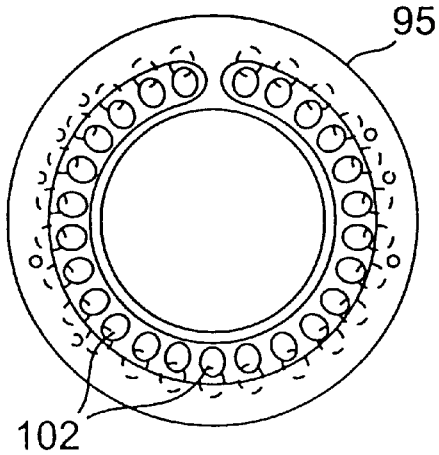
FIG. 26 is an elevational view of an end plate having a valve assembly in accordance with the present invention.
Figure 27:
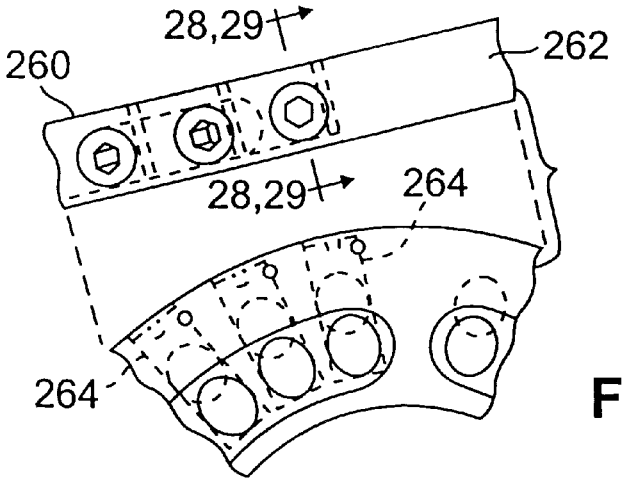
FIG. 27 is an enlarged view of the end plate and valve assembly shown in FIG. 26.

In order to increase the magnetic effect of the magnets 220, the individual magnets 220 may have a magnetic wire 250 extending between the individual magnets 220. In FIGS. 19 and 23, for example, each row of magnets 220 has a centrally disposed wire 250 extending along the axis 30 and connecting the individual magnets 220 in the respective row 230. It is believed that the wire 250 increases the overall magnetic effect of the magnets 220.

Referring to FIG. 19, it will be seen that the orifices 240 which are in radial communication with the feed tubes 80 are disposed so that they do not interfere with the centrally disposed wire 250. Alternatively, the wire 250 may be offset from the center of the magnets 240.

The cutting die 14 may be removed from the die holder 216 by exerting a significant tangential force thereon or by reducing the local induction of the magnets 240. The cutting operation, in certain conditions, may create sufficient tangential forces including, for example, the forces created by very high speed rotation of the die holder 216, which may displace a cutting die 14 of the type illustrated in FIG. 13A or cause the die 14 to slip such that it is improperly orientated relative to the blank B.

In order to prevent such displacement or slippage, the present invention envisions that the die holder 216 preferably provides at least one relatively thin slot 252 which is adapted to receive the leading end 202*a* of the cutting die 202 illustrated in FIG. 13A. Although the illustrated embodiment of the slot 252 extends along the longitudinal axis 30, it is may also be angularly displaced relative to the longitudinal axis 30. The engagement between the leading end 202*a* and the slot 252 prevents the cutting die 202 from slipping or becoming angularly displaced during the cutting operation. The slot 252 also eases assembly, making it possible to easily and readily mark and obtain the proper position of the die 202 on the die holder surface 21 without the need for cumbersome tools required in many conventional mechanical clamping assemblies. The slot 252 may be disposed anywhere along the periphery of the die holder 216.

In another embodiment, the die holder 216 may have two slots 252 for receiving a cutting die 14 of type illustrated in FIG. 13B—one slot receives the leading end 14*a* and the second slot receives the trailing end 14*b*. The width of the slot 252 may vary but it has been found that a width from about 0.004 to about 0.1 inch is sufficient to receive the cutting die end.

Figure 20:
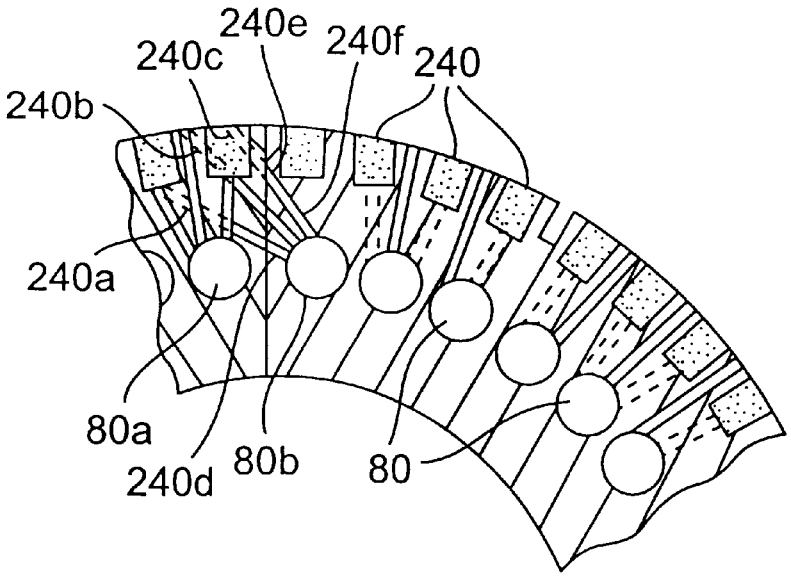
FIG. 20 is a view of the die holder taken along line 21—22 in FIG. 16 showing an embodiment wherein multiple orifices communicate with one feed tube.
Figure 21:
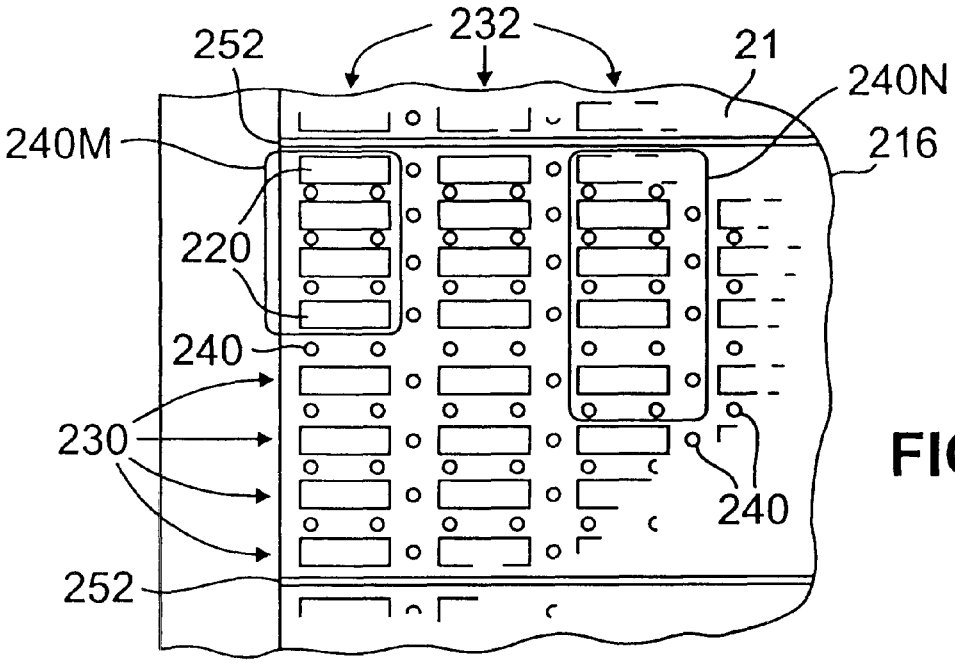
FIG. 21 is a partial elevational view illustrating the magnetic die holder.
Figure 22:
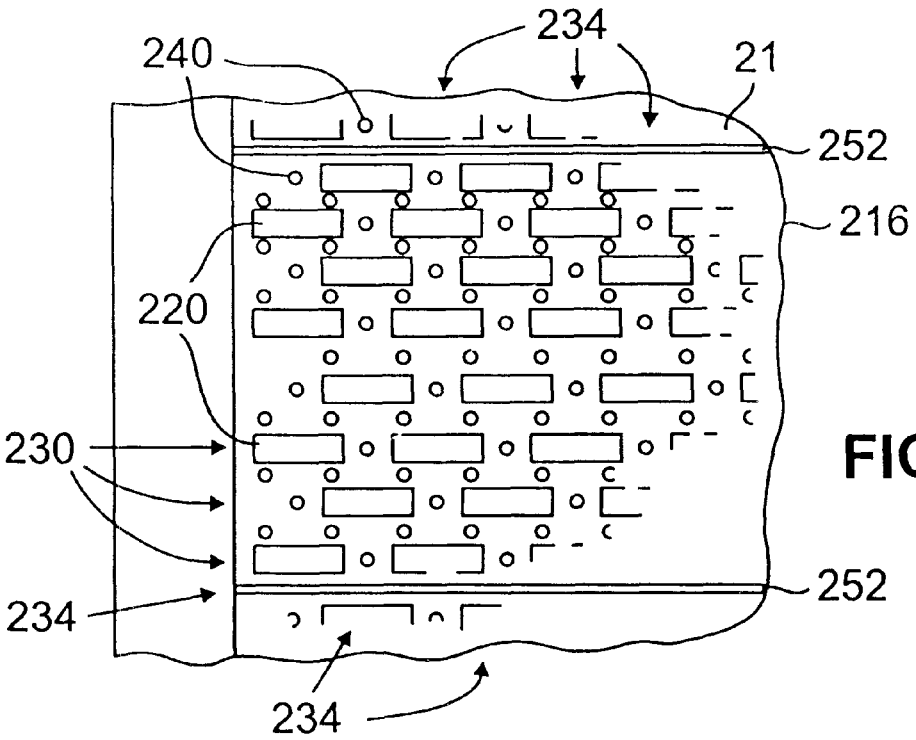
FIG. 22 is a partial elevational view of another embodiment of the magnetic die holder.

A further novel provision of the present invention is directed to enabling concentration of air and/or vacuum at desired locations of the die holder surface 21. As shown in FIG. 20, an embodiment is illustrated wherein multiple orifices 240*a*–240*c* are formed in die holder 216 that are in communication with feed tube 80*a*, and orifices 240*d*–*f* are in communication with feed tube 80*b*. FIG. 20 shows three such sets of orifices per feed tube 80; however, fewer or additional numbers of orifices could be so utilized per feed tube. One should note that two different feed tubes, 80*a* and 80*b* are feeding orifices that are in the same row across the face 21 of the rotary holder 216. This allows any arrangement desired of orifices across the die holder surface 21, i.e., in staggered fashion (FIG. 20 discussed hereinafter) or in a matrix, as discussed below. Moreover, it is also envisioned that multiple orifices 240*a*–240*f* could be provided in rows along the extending face of the die holder 216, but could also be provided in any matrix fashion as follows. In other words, as shown in FIG. 21, for example, orifice matrix area 240*m* could be provided by forming orifice channels into proper communication with feed tube 80*a*, such that the feed tube 80*a* is parallel and adjacent slot 252 which accepts the leading end 14*a* of the flexible cutting die 14. This arrangement would then provide a concentration of air, or vacuum at either or both matrix areas 240*m*, and 240*n*. One could alternate the provision of air and vacuum between these matrix areas, as desired, in accordance with the parameters of the job. For example, more or less than two circumferential rows of orifices 240*a*–*c* formed in combination of feed tubes 80*a* could be provided at any desired location of the die holder 216. One of ordinary skill can thus readily apprehend that concentrations and combinations of air and/or vacuum could thusly be enabled at any predetermined surface location of the die holder 216 through staggered orifice arrangements in cooperation with chosen feed tubes as a vacuum/air source.

Figure 10:
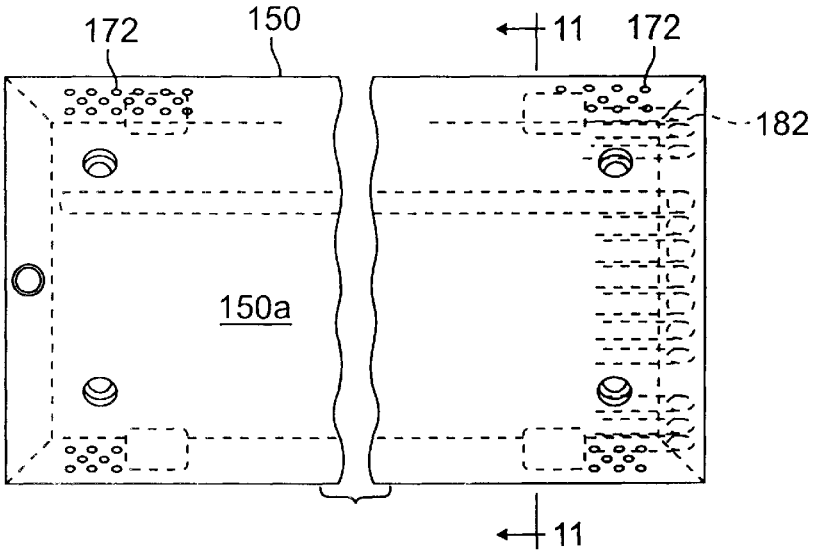
FIG. 10 is a top view of the embodiment of the cover plate illustrated in FIGS. 1–9.
Figure 11:
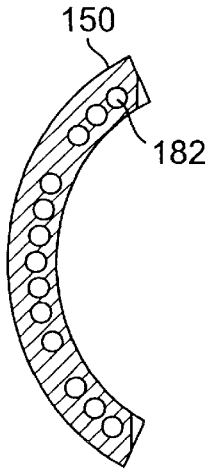
FIG. 11 is a sectional view of the cover plate taken along line 14—14 in FIG. 10.
Figure 12:
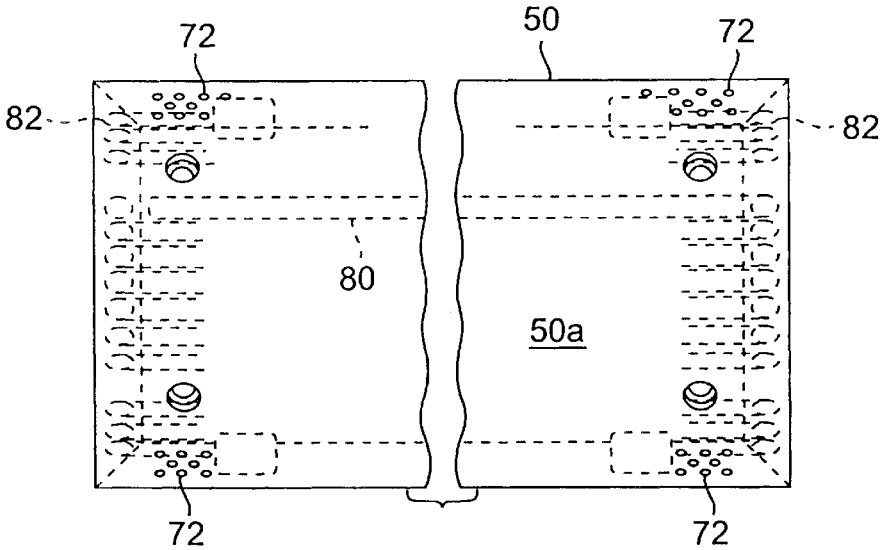
FIG. 12 is a top view of another embodiment of the cover plate.

In another embodiment of the cover plate 150 illustrated in FIGS. 10–11, the feed tubes 182 communicate with one side face of the cover plate 150 having an outer surface 150A. In applications where the cutting die 14 is disposed over the cover plate 150, the orifices 172 and feed tubes 180 which do not communicate with the die opening 20 and the associated panel P are sealed and the cover plate 150 is orientated so that the remaining open orifices 172 and feed tubes 182 communicate with the vacuum side of the air delivery assembly 90. Conversely, in applications where the cutting die 14 is not disposed over the cover plate 150, the orifices 172 and feed tubes 182 which communicate with the envelopes blank B are left open and the orientation of the cover plate 150 is reversed so that the feed tubes 172 communicate with the transport side of the air delivery assembly 90.

Figure 14:
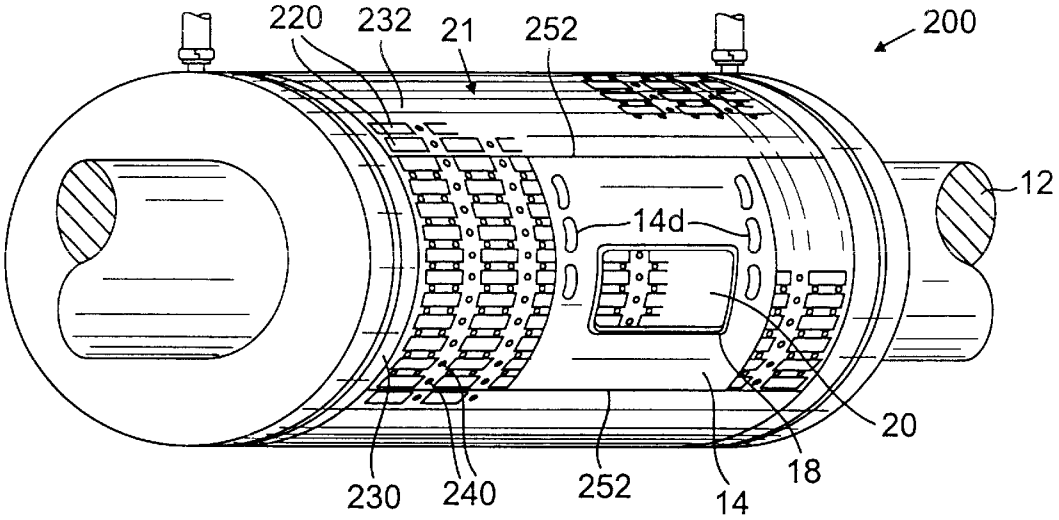
FIG. 14 is a perspective view of a magnetic rotary cutter assembly in a accordance with the present invention.
Figure 15:
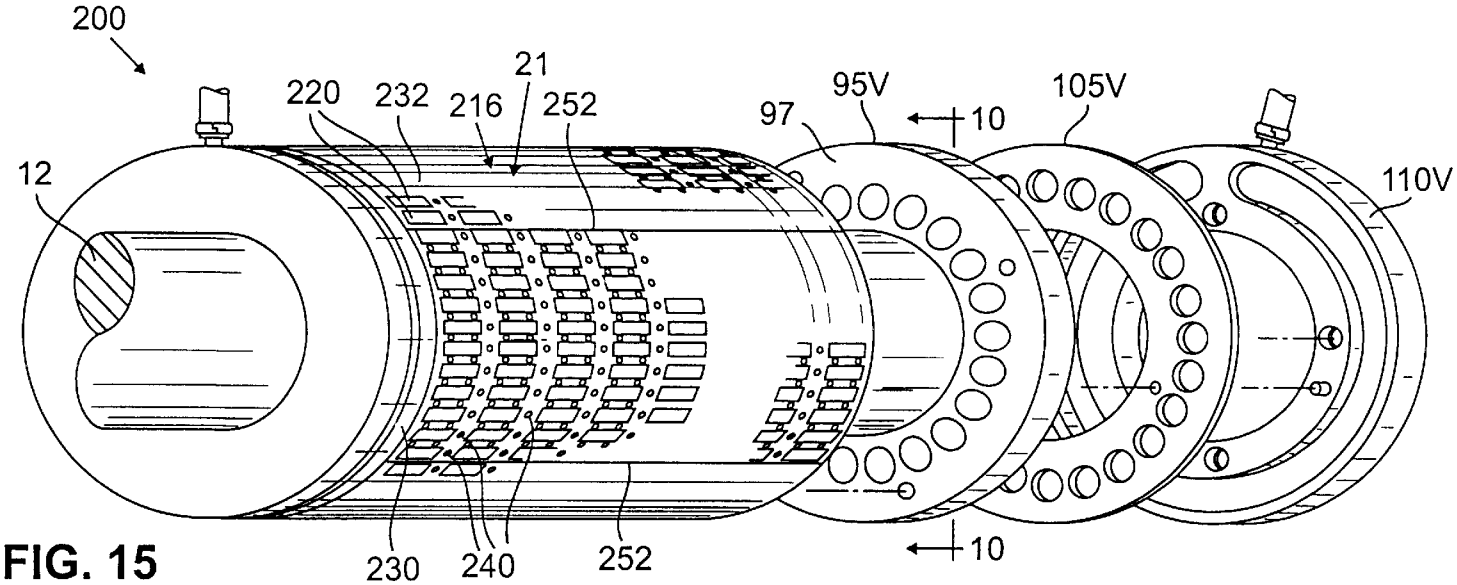
FIG. 15 is an exploded view of the rotary cutter assembly shown in FIG. 14.

As shown in FIGS. 13C and 14, apertures 14*d* are formed in the cutting die 14 at predetermined locations of the die. These apertures correspond to locations of general orifices 240 and matrix orifices 240*a*–240*f* on the die holder 216 for the purpose of either blocking or enabling the passage of air or vacuum to the vicinity of the die cutting edge 18. The location of these apertures 14*d* are determined in accordance with the requirements of the job.

Control of vacuum and/or air can be provided by general orifices 240 or matrix orifices 240*a*–240*f* by placing appropriately sized pieces of magnetically compatible sheet material (not shown) over those orifices to be disabled. Correspondingly, such a piece of sheet material could also have a plurality of rows of apertures 14*d*, 14*e* formed therein at appropriate locations thereof to control vacuum or air as desired, by blocking or unblocking the matrix orifices 240*a*–240*f*. See, FIGS. 13C, 14, and FIGS. 20A and 20B as discussed hereinbelow.

Figure 20A:
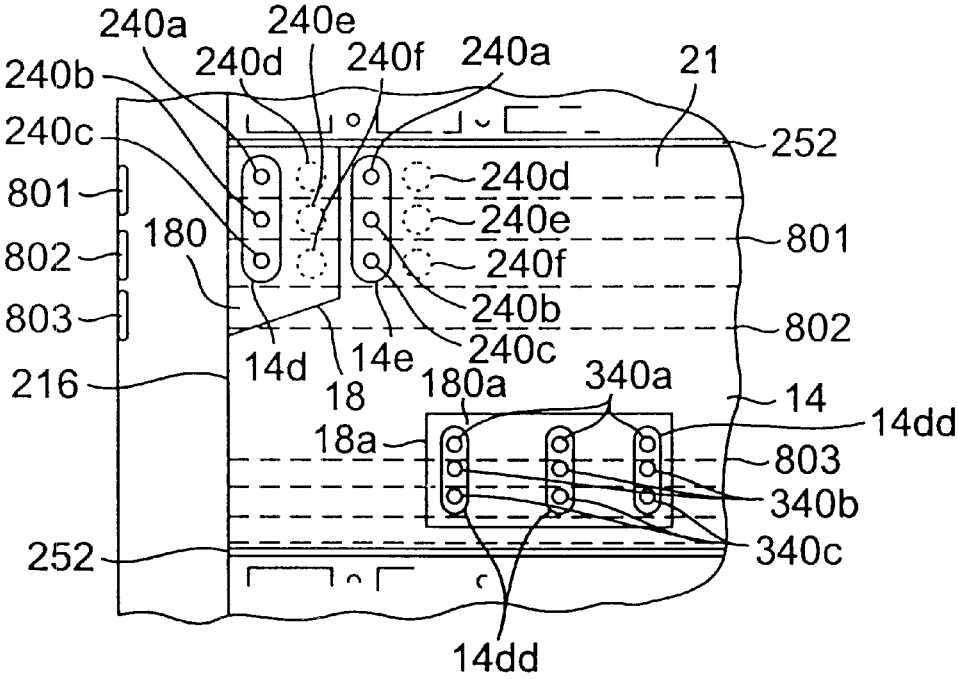
FIG. 20A is a partial elevational view of the rotary holder of FIG. 20 showing an alternative die plate and orifice system according to the invention.
Figure 20B:
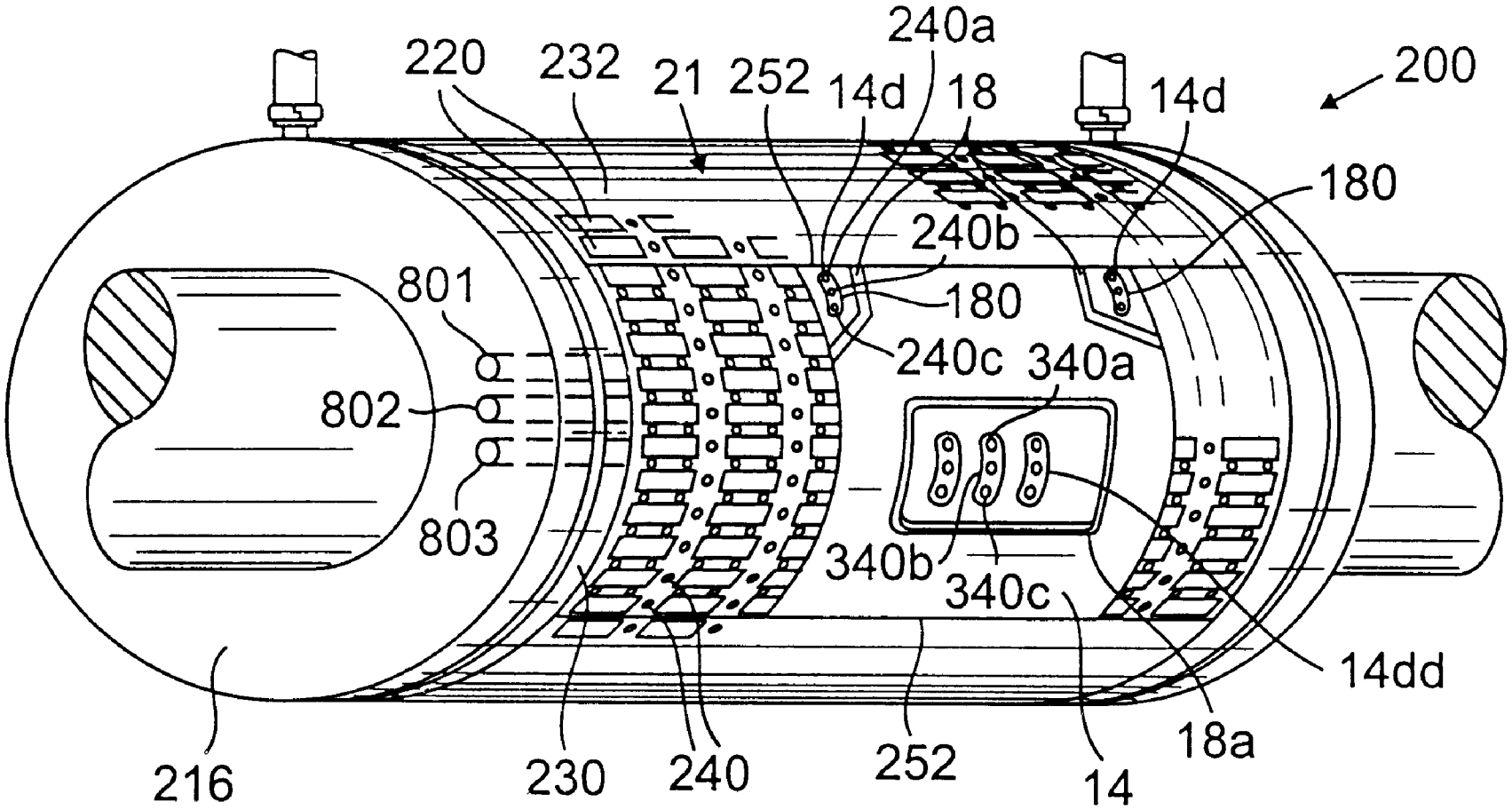
FIG. 20B is a perspective view of the rotary holder and die plate of FIG. 20A.

Another embodiment along these lines is shown in FIGS. 20A and 20B. A magnetically compatible cutting die 14 is fitted into the leading edge slot 252 and adhered to the surface 21 of the rotary die holder 216. The cutting die 14 as shown is directed to cutting an envelope blank (not shown) with cut out portions defined by the etched cutting edge 18. To effectuate precise control of the area 180 which would correspondingly be cut out from blank sheet material such as that used for envelopes (not shown), the die holder 216 provides a feed tube 801, wherein multiple orifices 240*a*–*c* are formed to be in communication therewith, as shown in FIGS. 20A and 20B. Correspondingly, feed tube 802 has multiple orifices 240*d*–*f* (FIG. 20B) formed in communication therewith. The cutting die 14 has cutouts 14*d*, 14*e* formed therein such that orifices 240*a*–*c* are open to the atmosphere at the cutouts. Note that in this example, orifices 240*d*–*f* are covered by the flexible die 14.

The cutting die 14 of FIGS. 20A and 20B also has a second cutting die area 18*a* formed to cut a window in the envelope sheet material (not shown). The plurality of orifices 340*a*–*c* are in communication with feed tube 803. The cutting die 14 has a plurality of cutouts 14*dd* which reveal three sets of orifices 340*a*–*c*. These orifices 340*a*–*c* are in communication with feed tube 803.

As discussed hereinabove as related to the control of vacuum and air to selected orifices through other provisions of the present invention directed to the control of feed tubes (FIGS. 8A–C, 9A–C), cutouts 14*d* and 14*dd* can provide vacuum or air as desired to areas 180 and 180*a* of the cutting die 14. For example, one may want orifices 240*a*–*c* within area 180 to provide vacuum while the rotary die holder 216 is cutting the envelope blank in order to keep the envelope blank adhered to the rotary die holder 216 for cutting the areas 180 and 180*a*; thereafter, one could apply air to those same orifices 240*a*–*c* to expel the cut envelope material therefrom.

The present invention also provides a method of providing control to the aforesaid orifices by providing yet another method of control in those instances when only minor changes, or updates are desired to a particular die's 14 application. This method utilizes placing tape over those orifices not to be used for a particular application. In other words, to re-use the cutting die 14, or use another cutting die (not shown) having other cutting areas 14*d* formed therein, activation and deactivation of any orifice 240*a*–*f* can take place by simply placing an appropriate section of adhesive tape (not shown) over those orifices 240*a*–*f* of interest. For example, tape could be placed over orifices 240*a*–*c* (FIG. 20A) to deactivate them, should the job so require. One could also deactivate orifices 240 revealed by cutouts 14*d*, 14*dd* in the cutting die 14 by applying adhesive tape as appropriate to cover those cutouts.

In the example shown in FIG. 20A, a window area is defined by the cutting edge 180*a*. A plurality of orifices 340*a*–*c* are in communication with feed tube 803 such that multiple cutouts 14*dd* can provide either air or vacuum to the area 180*a* of the envelope blank material (not shown) carried by the rotary die holder 216. In those instances when cutouts 14*dd* are to be rendered non-operational, simple adhesive tape (not shown) can be placed over appropriate orifices 14*dd* to block the provision of vacuum or air. Also, as disclosed hereinabove, a secondary sheet of magnetically compatible material can be sized to cover those orifices on the surface of the rotary die holder to accomplish much the same ends as placing tape over those orifices to be disabled. The advantage of tape is that tape can cover one or more orifices 240*a*–*f* on the surface 21 of the rotary die holder 216 and the rotary holder can still carry a cutting die 14 over the covered orifices.

Once again, one of ordinary skill can appreciate that the provision of multiple orifices 240*a*–*f* in communication with one feed tube 801–803 in matrices across the face 21 of the rotary die holder 216, allows novel and extraordinary control of the placement and provision of vacuum and air to any desired die pattern to be cut.

FIGS. 26–30 illustrate a novel valve assembly 260 for selectively controlling the flow of air to each of the feed tubes 80 from a source of vacuum or compressed air in contrast to conventional methods which use plastic plugs and tape which are easily removed or lost. The illustrated embodiment of the end plate 95 is a disc shaped body having front and back sides 97, 96 and an end peripheral face 262. The end plate 95 has a plurality of longitudinally extending holes 102 connecting the front and back sides 97, 96 and which are adapted to align with the feed tubes 80 disposed on the die holder 216. Each hole 102 has a corresponding axially extending valve hole 264 adapted to receive the valve member 260.

Figure 28:
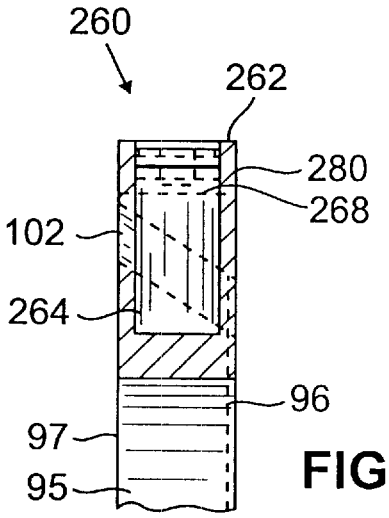
FIGS. 28–30 are sectional views taken through lines 30—30 and 31—31, respectively, in FIG. 27.

The valve member 260 has a bore 266 which is capable of selectively aligning with the corresponding end plate hole 102. When the valve bore 266 is aligned with the end plate hole 102 as shown in FIG. 28, the bore 266 and the hole 102 cooperate to feed vacuum or air through the end plate 95. When the valve member 260 is rotated 90 degrees as shown in FIG. 29, the valve bore 264 is perpendicular to the end plate hole 102 and the valve member 260 seals the end plate hole 102.

Figure 29:
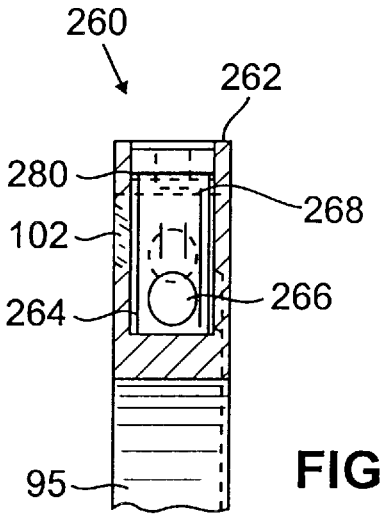
Figure 30:
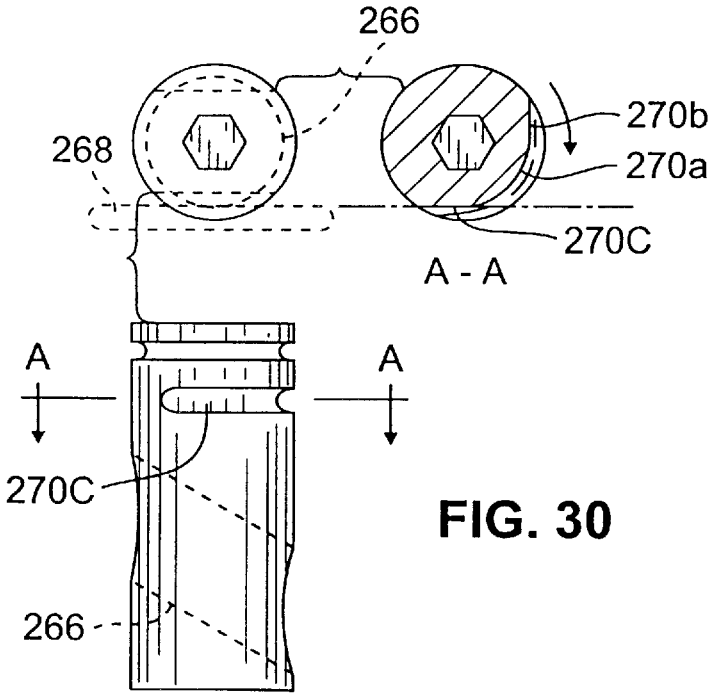

In accordance with a preferred embodiment, a valve member 260 is capable of selective and controlled rotation between a first closed position wherein the valve member 260 prevents flow through the end plate hole 102 (as shown in FIG. 29) and a second, open position wherein the valve member 260 permits flow through the end plate hole 102 (as shown in FIG. 28). Referring to FIGS. 28–30, the valve member 260 has a cam surface 270 which engages a pin 268 disposed in the valve hole. The shape of the cam surface 270 is such that the valve member 260 may rotate only between the closed and open positions. It will be appreciated that the valve member 260 insures that the individual end plate hole 102 is sealed by defining easily recognizable opened and closed positions. In the illustrated embodiment, the cam surface 270 has a curved portion 270*a* connecting two substantially perpendicular sides 270*b*, 270*c* which limit the rotation of the valve member. Although the head of the valve member 260 has a hex head adapted to receive a hex driver, the head may be adapted to receive any type of manual turning device including, for example, a screw driver and the like.

The valve member 260 also has a seal member 280 which provides a relatively airtight seal between the valve member 260 and the end plate 95. Although the illustrated embodiment of the valve member 260 is disposed in the end plate 95, it will be appreciated that the valve member 260 may also be disposed in the die holder 216 such that it communicates with the feed tube 80.

The novel concentration and locatability of vacuum and/or air provided by the invention allows very accurate timing of operations as hereinbefore described in conjunction with the application of air and vacuum through other aspects of the disclosed invention.

Thus, it will be seen that a die cutting apparatus and related cutting devices have been provided which attain the aforenoted objects. Although the structure and operation of the cutting die apparatus has been described in connection with the cutting of window panel from an envelope blank, it is not intended that the invention be limited only to such operations. Various additional modifications of the described embodiments of the invention specifically illustrated and described herein will be apparent to those skilled in the art, particularly in light of the teachings of this invention.

The invention may be utilized in the cutting of any pattern from any relatively thin and flexible sheetlike material blank, including, for example, paper, cloth or plastic materials and labels, sanitary napkins, and the like. The invention is also applicable in butt-cutting operations wherein one blank is cut from a stack of multiple adjacent blanks, and may be used with solid or flexible dies. The invention also permits the selective control of the transport, retention, and release of the separate blank and pattern members during the rotation of the die holder.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An apparatus for cutting a predetermined pattern from a material blank comprising:

a cylindrically shaped die holder having first and second opposed ends and a cylindrical outer surface having a plurality of longitudinal rows of orifices comprising a plurality of first and second orifices, said plurality of first and second orifices arranged within at least one of the rows in a regular predetermined pattern of alternating first and second orifices adjacent each other, wherein said first and second orifices independently supply to said outer surface vacuum and air at the same time;

at least one valving device for selectively independently valving said selected adjacent ones of said first and second orifices;

a plurality of first and second feed tubes disposed below said outer surface of said die holder, said first and second feed tubes selectively being independently valved to carry vacuum and air, said first orifices being in communication with said first feed tubes, said second orifices being in communication with said second feed tubes; and wherein said valving device comprises a flexible die plate placed over at lest one predetermined orifice.

2. The apparatus as set forth in claim 1, wherein said die plate comprises a flexible material of generally uniform thickness having a leading edge, said material having a plurality of apertures therein wherein at least one of said apertures serves as at least one of said valving device.

3. The assembly as set forth in claim 2, wherein said die plate is magnetically compatible and wherein said die holder further comprises magnet means for magnetically attracting and holding said die plate on said outer surface of said die holder.

4. A rotary holder assembly adapted to carry a magnetically compatible cutting die for cutting a pattern from a material blank, the assembly comprising:

a cylindrical die holder for rotating about an axis, the die holder comprising an outer surface having a laterally extending leading edge slot therein;

a plurality of feed tubes in said die holder below the outer surface thereof, a first of said feed tubes being adapted to carry a vacuum and a second of said feed tubes being adapted to carry air under pressure;

a plurality of first and second orifices opining onto said outer surface in a pattern of adjacent, first and second orifices;

said first and second orifices being in predetermined communication respectively with said first and second feed tubes, said plurality of first and second orifices supplying vacuum and air to said outer surface wherein at least one of said plurality of first orifices and at least one of said plurality of second orifices are disposed in a same longitudinal row on the outer surface of said die holder and wherein said first orifices and second orifices independently supply vacuum and air at the same time to the outer surface of said die holder.

5. The assembly of claim 4, wherein said first and second orifices are disposed adjacent each other in longitudinal rows on the outer surface of said die holder and wherein said first of said feed tubes feed vacuum to said first orifices and wherein said second said second feed tubes feed air to said second orifices.

6. The assembly as in claim 4, wherein one of the feed tubes is adjacent the leading edge slot.

7. The assembly of claim 4, further comprising said cutting die comprising a flexible magnetic material, said magnetic material having a leading edge and a trailing edge, said leading edge of the cutting die being received within the leading edge slot of said die holder, said cutting die having apertures therein, said apertures being located over predetermined ones of said first and second orifices.

8. The assembly of claim 7, wherein said die holder comprises magnet means for attracting and holding said cutting die substantially adjacent said leading edge.

9. The assembly of claim 7, wherein said cutting die further comprises at least one aperture formed therein, said aperture cooperating with at least one said plurality of first and second orifices adjacent to said leading edge slot of said die holder.

10. The assembly of claim 7, wherein said cutting die further comprises a plurality of apertures formed therein, each of said apertures cooperating respectively with at least one selected one of said plurality of first and second orifices.

11. A rotary die holder assembly capable of rotating a magnetic cutting die for cutting a pattern from a material blank and removing waste pattern material from said cutting die, said assembly comprising:

a cylindrical die holder, said die holder comprising an outer cylindrical surface, a plurality of magnetic members disposed in said die holder and flush with said outer surface for attaching the magnetic cutting die, said die holder outer surface carrying a plurality of first and second orifices disposed in a predetermined relationship with said magnetic members, said first and second orifices are arranged in a regular predetermined pattern of alternating independently valved adjacent first and second orifices within a same one longitudinal row, wherein said first orifices and second orifices independently supply vacuum and air at the same time to the outer cylindrical of said die holder;

said cutting die comprising a flexible sheet of magnetically compatible material having first and second sheet surfaces defined by at least one of a leading, trailing and opposing side edges, an impression surface raised above said first sheet surface;

said cutting die further having at least one aperture therein, said aperture being in direct communication with at least of one said orifices.

12. The system of claim 11, wherein said magnetic die holder further comprises at least one slot for receiving a leading of trailing edge of said cutting die.

13. The assembly recited by claim 11, wherein said cutting die comprises a plurality of apertures formed within said surface of said cutting die, said apertures being in direct communication with said orifices.

14. The assembly as set forth in claim 13, wherein said cutting die is held by magnetic attraction to said die holder, and said cutting die is at least partially located on said die holder by positioning said aperture relative to at least one said orifice.

15. The assembly as set forth in claim 13, wherein said impression surface has an inside perimeter and a plurality of apertures are disposed within said inside perimeter of said impression surface.

16. The assembly as set forth in claim 13, wherein said impression surface has a perimeter and a plurality of said apertures are disposed outside said perimeter of said impression surface.

17. A rotary die holder assembly adapted to carry a cutting die for cutting a pattern from a material blank, the assembly comprising:

a cutting die;

a cylindrical die holder adapted to rotate about a longitudinal axis, the cylindrical die holder having a cylindrical outer surface;

a plurality of first and second feed tubes disposed below said outer surface of said die holder;

said die holder further comprising a plurality of first and second orifices opening onto said outer surface, the orifices supplying to said outer surface one of vacuum and air;

wherein said first orifices are in communication with said plurality of first feed tubes;

wherein said second orifices are in predetermined communication with said plurality of second feed tubes;

wherein said plurality of first and second orifices are arranged in a regular pattern and wherein at least two adjacent ones of said plurality of first and second orifices within said regular pattern are located in a same row and are in communication with same ones of said feed tubes; and wherein said regular pattern is a series of first and second rows and wherein a plurality of said plurality of first and second orifices in both a first row and a second row of said pattern are in communication with a same one of said plurality of first and second feed tubes such that said first and second orifices are capable of independently supplying vacuum and air at the same time to the outer surface of the die holder.

18. The rotary die holder assembly of claim 17, wherein said plurality of first and second orifices forms a matrix pattern.

19. The rotary die holder assembly of claim 18, wherein said plurality of first and second orifices are grouped into a plurality of matrix patterns.

20. The rotary die holder of claim 17, further comprising a first valving means on said cylindrical outer surface for individually valving at least one of said plurality of first and second orifices.

21. The rotary die holder assembly of claim 20, wherein said first valving means for individually valving at least one of said plurality of first and second orifices comprises adhesive tape placed over said one orifice.

22. The rotary die holder assembly of claim 17, wherein said first and second orifices are valved in a predetermined pattern, and wherein said cutting die has cutting edges in a predetermined configuration adapted to cut a piece of material into a product blank and at least one waste portion, and wherein said plurality of first orifices are positioned in the area of said product blank and said plurality of second orifices are positioned in the area of said waste portion.

23. The rotary holder assembly of claim 22, wherein said first and second orifices are valved in a predetermined pattern.

24. The rotary die holder assembly of claim 17, wherein said die holder further comprises a laterally extending slot formed in said outer surface of said die holder, wherein said cutting die has a leading edge, said slot comprising means for retaining said leading edge of said cutting die, and wherein at least one of said plurality of first and second feed tubes and a plurality of said plurality of first and second orifices are adjacent to said slot.

25. The rotary die holder assembly of claim 24, wherein at least one of each of said plurality of first and second feed tubes is adjacent to said slot and wherein said plurality of first and second orifices are adjacent to said slot.

26. The rotary die holder assembly of claim 25, wherein said plurality of first orifices supplies vacuum to said surface and a plurality of second orifices supplies no vacuum to said surface.

27. The rotary die holder assembly of claim 17, wherein said cutting die has at least one aperture therein and wherein said aperture provides a means for selectively and individually valving at least one of said plurality of first and second orifices.

28. The rotary die holder assembly of claim 27, further comprising means for blocking said aperture.

29. The rotary die holder assembly of claim 28, wherein said means for blocking comprises adhesive tape.

30. A controllable and adjustable universal cutting die holder apparatus for cutting material that allows use of the die holder at various times to cut at least one a plurality of different sizes and shapes and from different locations on the material, said apparatus comprising:

a cylindrical die holder rotatable about a longitudinal axis and having a cylindrical outer surface;

a vacuum source for providing a controlled source of vacuum;

an air source providing a controlled source of air and pressure;

wherein said die holder further comprises:

a plurality of first and second feed tubes in, and below the outer surface of, said cylindrical die holder, extending generally parallel to the longitudinal axis;

valving means providing independent and concurrent selective coupling of each of said plurality of first and second feed tubes to a respective one of the vacuum source and air source; and a plurality of first and second orifices opening onto the cylindrical outer surface thereof, each of said orifices communicating generally radially with ones of said respective first and second feed tubes;

wherein a plurality of said first and second orifices are arranged in a matrix comprising a plurality of rows across said outer surface, and wherein selected ones of said first and second orifices are located adjacent each other within a same one row and are independently valved to selectively provide availability of vacuum and air responsive to the valving means.

31. An apparatus according to claim 30, wherein said cylindrical die holder further comprises:

a cylindrical periphery;

a first axial end;

a second axial end; and an air delivery assembly comprising a transport assembly and a vacuum assembly, said first axial end being adjacent said transport assembly and said second axial end being adjacent said vacuum assembly;

wherein said plurality of first and second feed tubes are located in alternating positions around at least a portion of said cylindrical periphery, wherein each of the plurality of said first feed tubes communicates respectively with said transport assembly and each of the plurality of said second feed tubes communicates respectively with said vacuum assembly.

32. An apparatus according to claim 30, wherein said orifices on said outer surface of said die holder are arranged in a predetermined pattern comprising a plurality of rows forming a matrix, said predetermined pattern comprising alternating adjacent first and second orifices within a same one row.

33. An apparatus according to claim 30, wherein each of said first and second feed tubes is coupled to respective first and second groups of multiple orifices located in alternating adjacent positions in respective ones of the rows.

34. An apparatus according to claim 33, wherein each respective first and second group of orifices comprises three orifices.

* * * * *